US008899321B2

(12) United States Patent
Dawson et al.

(10) Patent No.: US 8,899,321 B2
(45) Date of Patent: Dec. 2, 2014

(54) METHOD OF DISTRIBUTING A VISCOSITY REDUCING SOLVENT TO A SET OF WELLS

(75) Inventors: Matthew A Dawson, Houston, TX (US); Owen J Hehmeyer, Houston, TX (US); Robert D Kaminsky, Houston, TX (US); Mori Y Kwan, Calgary (CA); Jean-Pierre Lebel, Calgary (CA); Robert Chick Wattenbarger, Houston, TX (US); Thomas J Boone, Calgary (CA)

(73) Assignee: ExxonMobil Upstream Research Company, Houston, TX (US)

( * ) Notice: Subject to any disclaimer, the term of this patent is extended or adjusted under 35 U.S.C. 154(b) by 384 days.

(21) Appl. No.: 13/084,256

(22) Filed: Apr. 11, 2011

(65) Prior Publication Data

US 2011/0295771 A1 Dec. 1, 2011

(30) Foreign Application Priority Data

May 26, 2010 (CA) ..... 2,705,643

(51) Int. Cl.
*E21B 47/00* (2012.01)
*E21B 43/16* (2006.01)
*G06Q 99/00* (2006.01)

(52) U.S. Cl.
CPC ..... *E21B 43/16* (2013.01); *G06Q 99/00* (2013.01)
USPC ..... 166/252.1; 166/305.1

(58) Field of Classification Search
None
See application file for complete search history.

(56) References Cited

U.S. PATENT DOCUMENTS

| | | | |
|---|---|---|---|
| 849,524 | A | 4/1907 | Baker |
| 1,246,993 | A | 11/1917 | Payet |
| 2,188,012 | A | 1/1940 | Pilat et al. |
| 2,412,765 | A | 7/1941 | Buddrus |
| 2,365,591 | A | 8/1942 | Ranney |

(Continued)

FOREIGN PATENT DOCUMENTS

| | | |
|---|---|---|
| CA | 940853 | 1/1974 |
| CA | 1015656 | 8/1977 |

(Continued)

OTHER PUBLICATIONS

Butler, R. M. et al. (1991) "A New Process (VAPEX) for Recovering Heavy Oils Using Hot Water and Hydrocarbon Vapour" *J. of Canadian Petroleum Technology*, vol. 30, pp. 97-106.

(Continued)

*Primary Examiner* — Angela M DiTrani
*Assistant Examiner* — Anuradha Ahuja
(74) *Attorney, Agent, or Firm* — ExxonMobil Upstream Research—Law Department

(57) ABSTRACT

Described are methods of distributing a viscosity reducing solvent to a set of wells terminating in an underground oil reservoir where the variation in the net solvent injection rate is minimized. The net solvent injection rate is the difference between the total solvent injection rate and the total solvent production rate from the set of wells, for example on an instantaneous or daily rate basis. Minimizing this variation can reduce costs associated with surface solvent storage, subsurface solvent storage, and solvent supply, since solvent supply often is least expensive when supplied at near a fixed rate. One option is to operate well pairs and to inject solvent into one well of the pair while producing oil and solvent from the other well of the pair. These methods are particularly useful in solvent-dominated, cyclic or non-cyclic, viscous oil recovery processes.

21 Claims, 7 Drawing Sheets

(56) References Cited

U.S. PATENT DOCUMENTS 2,358,183 A 9/1944 Ostergaard
2,655,465 A 10/1953 Martin
3,074,481 A 1/1963 Habermann
3,185,634 A 5/1965 Craig, Jr. et al.
3,274,101 A * 9/1966 West et al. ..... 208/340
3,323,588 A 6/1967 Rai et al.
3,342,256 A 9/1967 Bernard et al.
3,434,544 A 3/1969 Satter et al.
3,608,638 A 9/1971 Terwilliger
3,671,419 A 6/1972 Ireland et al.
3,704,990 A 12/1972 Sarem et al.
3,705,625 A 12/1972 Whitten et al.
3,707,189 A 12/1972 Prats
3,739,852 A 6/1973 Woods et al.
3,782,465 A 1/1974 Bell et al.
3,811,503 A 5/1974 Burnett et al.
3,818,989 A 6/1974 Christopher, Jr. et al.
3,823,777 A 7/1974 Allen et al.
3,878,892 A 4/1975 Allen et al.
3,908,762 A 9/1975 Redford
3,945,435 A 3/1976 Barry
3,946,809 A 3/1976 Hagedorn
3,948,319 A 4/1976 Pritchett
3,954,141 A 5/1976 Allen et al.
3,956,145 A 5/1976 Christopher, Jr. et al.
3,958,636 A 5/1976 Perkins
3,960,214 A 6/1976 Howell et al.
3,986,557 A 10/1976 Striegler et al.
4,004,636 A 1/1977 Brown et al.
4,007,785 A * 2/1977 Allen et al. ..... 166/272.1
4,007,787 A 2/1977 Cottle
4,008,764 A 2/1977 Allen
4,010,799 A 3/1977 Kern et al.
4,017,383 A 4/1977 Beavon
4,017,388 A 4/1977 Albertson
4,017,583 A 4/1977 Motojima et al.
4,020,901 A 5/1977 Pisio et al.
4,026,358 A 5/1977 Allen
4,034,812 A 7/1977 Widmyer
4,037,658 A 7/1977 Anderson
4,067,391 A 1/1978 Dewell
4,085,803 A 4/1978 Butler
4,099,568 A 7/1978 Allen
4,109,720 A 8/1978 Allen et al.
4,125,044 A 11/1978 Carrigan et al.
4,125,458 A 11/1978 Bushnell et al.
4,169,044 A 9/1979 Crowley
4,223,728 A 9/1980 Pegg
4,228,853 A 10/1980 Harvey et al.
4,228,854 A 10/1980 Sacuta
4,260,019 A 4/1981 Blair, Jr.
4,280,559 A 7/1981 Best
4,344,485 A 8/1982 Butler ..... 166/271
4,362,213 A 12/1982 Tabor
4,412,585 A 11/1983 Bouck
4,424,866 A 1/1984 McGuire
4,444,261 A 4/1984 Islip
4,450,909 A 5/1984 Sacuta
4,456,065 A 6/1984 Heim et al.
4,459,142 A 7/1984 Goddin, Jr.
4,476,928 A 10/1984 Green
4,489,782 A 12/1984 Perkins
4,495,995 A 1/1985 Chen et al.
4,510,997 A 4/1985 Fitch et al. ..... 166/263
4,513,819 A 4/1985 Islip et al.
4,540,050 A 9/1985 Huang et al.
4,617,993 A 10/1986 Brown
4,627,495 A 12/1986 Harris et al.
4,676,889 A 6/1987 Hsieh et al.
4,678,036 A * 7/1987 Hartman et al. ..... 166/403
4,687,058 A * 8/1987 Casad et al. ..... 166/272.2
4,706,752 A 11/1987 Holm
4,819,724 A 4/1989 Bou-Mikael et al.
4,856,588 A 8/1989 Borchardt
4,921,576 A 5/1990 Hurd
4,969,130 A 11/1990 Wason et al.
5,025,863 A 6/1991 Haines et al.
5,027,898 A 7/1991 Naae
5,052,487 A 10/1991 Wall
5,060,727 A 10/1991 Schramm et al.
5,076,364 A 12/1991 Hale et al.
5,095,984 A 3/1992 Irani ..... 166/268
5,105,884 A 4/1992 Sydansk
5,129,457 A 7/1992 Sydansk
5,167,280 A 12/1992 Sanchez et al.
5,174,377 A * 12/1992 Kumar ..... 166/245
5,236,577 A 8/1993 Tipman et al.
5,246,071 A * 9/1993 Chu ..... 166/245
5,350,014 A 9/1994 McKay
5,358,046 A 10/1994 Sydansk et al.
5,386,875 A 2/1995 Venditto et al.
5,400,030 A 3/1995 Duren et al.
5,407,009 A 4/1995 Butler et al.
5,491,269 A 2/1996 Colle et al.
5,607,016 A 3/1997 Butler
5,674,816 A 10/1997 Loree
5,720,350 A 2/1998 McGuire
5,725,054 A 3/1998 Shayegi et al.
5,771,973 A 6/1998 Jensen et al.
5,826,656 A 10/1998 McGuire et al.
5,855,243 A 1/1999 Bragg
5,876,592 A 3/1999 Tipman et al.
5,899,274 A 5/1999 Frauenfeld et al.
5,910,467 A 6/1999 Bragg
5,927,404 A 7/1999 Bragg
5,968,349 A 10/1999 Duyvesteyn et al.
6,007,709 A 12/1999 Duyvesteyn et al.
6,039,116 A 3/2000 Stevenson et al.
6,068,054 A 5/2000 Bragg
6,074,558 A 6/2000 Duyvesteyn et al.
6,174,431 B1 1/2001 Williams
6,214,175 B1 4/2001 Heinemann et al.
6,214,213 B1 4/2001 Tipman et al.
6,244,341 B1 6/2001 Miller
6,318,464 B1 11/2001 Mokrys
6,357,526 B1 3/2002 Abdel-Halim et al.
6,358,403 B1 3/2002 Brown et al.
6,358,404 B1 3/2002 Brown et al.
6,405,799 B1 6/2002 Vallejos et al.
6,484,805 B1 11/2002 Perkins
6,591,908 B2 7/2003 Nasr
6,662,872 B2 12/2003 Gutek et al.
6,708,759 B2 3/2004 Leaute et al.
6,712,215 B2 3/2004 Scheybeler
6,769,486 B2 8/2004 Lim et al.
6,782,946 B2 8/2004 Perkins et al.
6,800,116 B2 10/2004 Stevens et al.
6,882,607 B2 4/2005 Sano et al.
6,883,607 B2 4/2005 Nenniger et al.
6,978,837 B2 12/2005 Yemington
7,067,811 B2 6/2006 Long et al.
7,073,837 B2 7/2006 Madlinger
7,096,092 B1 8/2006 Ramakrishnan et al.
7,141,162 B2 11/2006 Garner et al.
7,165,616 B2 1/2007 Jorgensen
7,165,621 B2 1/2007 Ayoub et al.
7,234,524 B2 6/2007 Shaw et al.
7,248,969 B2 7/2007 Patzek et al.
7,259,688 B2 8/2007 Hirsch et al.
7,272,973 B2 9/2007 Craig
7,289,942 B2 * 10/2007 Yang et al. ..... 703/10
7,294,156 B2 11/2007 Chakrabarty et al.
7,303,018 B2 12/2007 Cawiezel et al.
7,363,973 B2 4/2008 Nenniger et al.
7,418,307 B2 8/2008 Katircioglu
7,434,619 B2 10/2008 Rossi et al.
7,451,066 B2 11/2008 Edwards et al.
7,464,756 B2 12/2008 Gates et al. ..... 166/272.3
7,465,389 B2 12/2008 Sirota et al.
7,478,024 B2 1/2009 Gurpinar et al.
7,527,096 B2 5/2009 Chung et al.
7,540,951 B2 6/2009 Selmen et al.
7,546,228 B2 6/2009 Cullick et al.
7,585,407 B2 9/2009 Duyvesteyn et al.

(56) References Cited

U.S. PATENT DOCUMENTS

| | | | | |
|---|---|---|---|---|
| 7,711,486 | B2 | 5/2010 | Thigpen et al. | |
| 7,769,486 | B2 | 8/2010 | McHenry et al. | |
| 8,118,096 | B2 | 2/2012 | Ayasse | |
| 2002/0007947 | A1* | 1/2002 | Patel et al. | 166/252.1 |
| 2003/0015321 | A1* | 1/2003 | Lim et al. | 166/263 |
| 2003/0141053 | A1 | 7/2003 | Yuan et al. | |
| 2004/0149431 | A1 | 8/2004 | Wylie et al. | |
| 2005/0150844 | A1 | 7/2005 | Hyndman et al. | |
| 2005/0263437 | A1 | 12/2005 | Howdeshell | |
| 2006/0113218 | A1 | 6/2006 | Hart et al. | |
| 2006/0115221 | A1 | 6/2006 | Chalifoux et al. | |
| 2006/0138036 | A1 | 6/2006 | Garner et al. | |
| 2006/0138055 | A1 | 6/2006 | Garner et al. | |
| 2006/0162922 | A1* | 7/2006 | Chung et al. | 166/245 |
| 2006/0260980 | A1 | 11/2006 | Yeung | |
| 2006/0289157 | A1 | 12/2006 | Rao | |
| 2007/0106545 | A1 | 5/2007 | Jowers et al. | |
| 2007/0108098 | A1 | 5/2007 | Flint et al. | |
| 2007/0111903 | A1 | 5/2007 | Engel et al. | |
| 2007/0122104 | A1 | 5/2007 | Chalifoux et al. | |
| 2007/0179766 | A1 | 8/2007 | Cullick et al. | |
| 2007/0187090 | A1 | 8/2007 | Nguyen et al. | |
| 2007/0199710 | A1 | 8/2007 | Hocking | |
| 2008/0126168 | A1 | 5/2008 | Carney et al. | |
| 2008/0167511 | A1 | 7/2008 | Prim | |
| 2008/0262736 | A1 | 10/2008 | Thigpen et al. | |
| 2008/0262737 | A1* | 10/2008 | Thigpen et al. | 702/9 |
| 2008/0275796 | A1 | 11/2008 | Katircioglu | |
| 2008/0277113 | A1 | 11/2008 | Stegemeier et al. | |
| 2008/0294484 | A1 | 11/2008 | Furman et al. | |
| 2009/0008290 | A1 | 1/2009 | Biswas et al. | |
| 2009/0012765 | A1* | 1/2009 | Raphael | 703/10 |
| 2009/0145606 | A1 | 6/2009 | Hocking | |
| 2009/0159277 | A1 | 6/2009 | Hocking | |
| 2009/0194282 | A1 | 8/2009 | Beer et al. | |
| 2009/0242463 | A1 | 10/2009 | Chirinos et al. | |
| 2010/0006285 | A1 | 1/2010 | Da Silva et al. | |
| 2010/0012331 | A1 | 1/2010 | Larter et al. | |
| 2010/0032348 | A1 | 2/2010 | Duyvesteyn et al. | |
| 2010/0147516 | A1 | 6/2010 | Betzer-Zilevitch | |
| 2010/0155062 | A1 | 6/2010 | Boone et al. | |
| 2010/0218954 | A1 | 9/2010 | Yale et al. | |
| 2010/0276341 | A1 | 11/2010 | Speirs et al. | |
| 2011/0120717 | A1 | 5/2011 | LaMont et al. | |
| 2011/0198086 | A1 | 8/2011 | Kwan et al. | |
| 2011/0198091 | A1 | 8/2011 | Sirota et al. | |
| 2011/0224907 | A1 | 9/2011 | Chalifoux | |
| 2011/0226471 | A1 | 9/2011 | Wattenbarger et al. | |
| 2011/0264373 | A1 | 10/2011 | Hehmeyer et al. | |

FOREIGN PATENT DOCUMENTS

| | | | |
|---|---|---|---|
| CA | 1059432 | 7/1979 | |
| CA | 1122115 | 4/1982 | |
| CA | 1246993 | 12/1988 | |
| CA | 2043092 | 11/1992 | |
| CA | 2058812 | 7/1993 | |
| CA | 2108723 | 10/1993 | |
| CA | 2108349 | 11/1993 | |
| CA | 2075108 | 1/1994 | |
| CA | 2120851 | 8/1995 | |
| CA | 2232403 | 2/1998 | |
| CA | 2185837 | 3/1998 | |
| CA | 2200899 | 9/1998 | |
| CA | 2232929 | 9/1998 | |
| CA | 2270703 | 10/2000 | |
| CA | 2312621 | 12/2000 | |
| CA | 2243105 | 11/2001 | |
| CA | 2141112 | 11/2002 | |
| CA | 2353109 | 1/2003 | |
| CA | 2310959 | 1/2004 | |
| CA | 2471048 | 3/2004 | |
| CA | 2527058 | 3/2004 | |
| CA | 2505411 | 7/2004 | |
| CA | 2425840 | 10/2004 | |
| CA | 2306016 | 11/2004 | |
| CA | 2349234 | 12/2004 | |
| CA | 2435113 | 1/2005 | |
| CA | 2493677 | 6/2005 | |
| CA | 2455011 | 7/2005 | |
| CA | 2462359 | 9/2005 | |
| CA | 2520943 | 4/2006 | |
| CA | 2490734 | 6/2006 | |
| CA | 2494391 | 7/2006 | |
| CA | 2502329 | 9/2006 | |
| CA | 2538464 | 9/2006 | |
| CA | 2147079 | 10/2006 | |
| CA | 2235085 | 1/2007 | |
| CA | 2281276 | 2/2007 | |
| CA | 2521248 | 3/2007 | |
| CA | 2587166 | 9/2007 | |
| CA | 2552482 | 1/2008 | |
| CA | 2304938 | 2/2008 | E21B 43/24 |
| CA | 2630682 | 6/2008 | |
| CA | 2351148 | 7/2008 | |
| CA | 2304938 | 12/2008 | |
| CA | 2591354 | 12/2008 | |
| CA | 2332685 | 3/2010 | |
| CA | 2688392 | 6/2011 | |
| CA | 2724806 | 6/2011 | |
| EP | 1355169 | 10/2003 | |
| EP | 2022936 | 2/2009 | |
| SU | 1723314 | 3/1992 | |
| WO | WO99/33936 | 8/1999 | |
| WO | WO2006/044199 | 4/2006 | G06F 17/50 |
| WO | WO 2006/044199 | 4/2006 | |
| WO | WO 2008/009114 | 1/2008 | |
| WO | WO2008/009114 | 1/2008 | E21B 43/24 |
| WO | WO 2008/070990 | 6/2008 | |
| WO | WO 2009/014586 | 1/2009 | |
| WO | WO2009/061433 | 5/2009 | G06F 19/00 |
| WO | WO 2009/061433 | 5/2009 | |
| WO | WO 2009/067423 | 5/2009 | |
| WO | WO 2009/075962 | 6/2009 | |
| WO | WO 2010/039029 | 4/2010 | |

OTHER PUBLICATIONS

Feali, M. et al. (2008) "Feasibility Study of the Cyclic VAPEX Process for Low Permeable Carbonate Systems", *Int'l Petroleum Technology Conference*, Paper 12833, 5 pgs.

Lim, G. B. et al. (1995) "Cyclic Stimulation of Cold Lake Oil Sand with Supercritical Ethane", SPE Paper 30298, pp. 521-528.

Lim, G. B. et al. (1996) "Three-dimensional Scaled Physical Modeling of Solvent Vapour Extraction of Cold Lake Bitumen", *Journal of Canadian Petroleum Technology*, 35(4), pp. 32-40.

Rostami, B. et al. (2005) "Investigation of the Vapex Process in High-Pressure Fractured Heavy-Oil Reservoirs," *SPE*, SPE/PS-CIM/CHOA 97766, Alberta, Canada, 9 pgs.

Vagnetti, R. et al. (2009) "Solvent Based Enhanced Oil Recovery for In-Situ Upgrading of Heavy Oil", www.netl.doe.gov/technologies/oil-gas/Petroleum/projects/EP/ImprovedRec/42745SolventEOR.html.

ASTM D 2887 (1997).

Azin et al. (2007)"Investigation of the Vapex Performance in High Pressure Heavy Oil Reservoirs".

Black, L. (2003) "VAPEX—A New Propane Market," *Propane Canada* May/Jun. 2003, http://findarticles.com/p/articles/mi_qa5410/is_200305/ai_n21332180/, pp. 1613-1623.

Boberg, T.C. et al (1966) "Calculation of the production of a thermally stimulated well", *JPT*, pp. 1613-1623, Dec. 1966.

Budd, G. (2007) "New Technology Could Substantially Boost SAGD Potential," *Oil Sands Review*, 2 pages.

Butler, R. M. et al. (1991) "A New Process (VAPEX) for Recovering Heavy Oils Using Hot Water and Hydrocarbon Vapour," *Jrnl. of Canadian Petroleum Tech.*, v. 30, pp. 97-106.

Butler, R. M. et al. (1993) "Recovery of Heavy Oils Using Vapourized Hydrocarbon Solvents: Further Development of the Vapex Process," *Journal of Canadian Petroleum Technology*, June, v. 32, No. 6, pp. 56-62.

(56) References Cited

OTHER PUBLICATIONS

Cuthiell, D. et al. (2003) "Investigation of the VAPEX Process Using CT Scanning and Numerical Simulation," *Jrnl. of Canadian Petroleum Tech*., v. 42.2, pp. 41-49.
Cuthiell, D. et al. (2006) "Viscous Fingering Effects in Solvent Displacement of Heavy Oil," *Jrnl. of Canadian Petroleum Tech*., v. 45.7, pp. 29-39.
Feali, M. et al. (2008) "Feasibility Study of the Cyclic VAPEX Process for Low Permeable Carbonate Systems," *International Petroleum Technology Conference Paper 12833*.
Gallant, R. J. et al. (1993) "Steaming and Operating Strategies at a Midlife CSS Operation," *SPE 25794*, pp. 183-194.
Gupta, S. et al. (2001) "Insights into Some Key Issues with Solvent Aided Process," *Petroleum Society-Canadian Institute of Mining, Metallurgy & Petroleum*, Paper No. 2001-126, pp. 1-23.
Katz et al. (1959) "Handbook of Natural Gas Engineering," *McGraw-Hill*, p. 212.
Lim, G. B. et al. (1995) "Cyclic Stimulation of Cold Lake Oil Sand with Supercritical Ethane," *SPE Paper 30298*, pp. 521-528.
Rostami, B. et al. (2005) "Investigation of the Vapex Process in High-Pressure Fractured Heavy-Oil Reservoirs," *SPE 97766*, Alberta, Canada.
Sloan, Jr., E. D. (1998) "Clathrate Hydrate of Natural Gases," *2nd ed. Marcel Dekker, Inc. New York*, pp. 162, 170, 200-201, 269, 520.
Turta, A. T. et al. (2004) "Overview of Short-Distance Oil Displacement Processes," *Jrnl. of Canadian Petroleum Tech*., v. 43, pp. 29-38.
Upreti, S. R. et al. (2007) "Vapor Extraction of Heavy Oil and Bitumen: A Review," *Energy & Fuels*, v. 21, pp. 1562-1574.
Vagnetti, R. et al. (2009) "Solvent Based Oil Recovery for In-Situ Upgrading of Heavy Oil," www.netl.doe.gov/technologies/oil-gas/Petroleum/projects/EP/ImprovedRec/42745SolventEOR.html.
Vogel, J. V. (1996) "How Solvent Vapors Can Improve Steam Floods," *World Oil*, Nov. 1996, pp. 75-77.
Nasr, T.N. et al. (1991) "A Novel Scaled Physical Simulator for Horizontal Well Enhanced Oil Recovery," *Petroleum Society of CIM and CANMET*, Paper No. 5.

* cited by examiner

METHOD OF DISTRIBUTING A VISCOSITY REDUCING SOLVENT TO A SET OF WELLS

CROSS-REFERENCE TO RELATED APPLICATIONS

This application claims priority from Canadian patent application number 2,705,643 filed on May 26, 2010, entitled "Method of Distributing a Viscosity Reducing Solvent to a Set of Wells," the entirety of which is incorporated by reference herein.

This application contains subject matter related to U.S. Published application Ser. No. 2011/0198091 filed on Jan. 10, 2011, entitled "Solvent Separation In A Solvent-Dominated Recovery Process"; U.S. Published application Ser. No. 2011/0198086 filed on Jan. 10, 2011, entitled "Hydrate Control In A Cyclic Solvent-Dominated Hydrocarbon Recovery Process"; U.S. Published application Ser. No. 2011/0226471 filed on Jan. 27, 2011, entitled "Use of a Solvent and Emulsion for In-Situ Oil Recovery" and U.S. Published application Ser. No. 2011/0264373 filed on Feb. 22, 2011, entitled "Method for the Management of Oilfields Undergoing Solvent Injection".

FIELD OF THE INVENTION

The present invention relates generally to in situ hydrocarbon recovery including in situ viscous oil recovery. More particularly, the present invention relates to reducing pipeline capacity, surface solvent storage, or underground solvent storage costs in a solvent-dominated process for recovering in situ hydrocarbons.

BACKGROUND OF THE INVENTION

Solvent-dominated in situ oil recovery processes are those in which chemical solvents are used to reduce the viscosity of the in situ oil. A minority of commercial viscous oil recovery processes use solvents to reduce viscosity. Most commercial recovery schemes rely on thermal methods such as Cyclic Steam Stimulation (CSS, see, for example, U.S. Pat. No. 4,280,559) and Steam-Assisted Gravity Drainage (SAGD, see, for example U.S. Pat. No. 4,344,485) to reduce the viscosity of the in situ oil. As thermal recovery technology has matured, practitioners have added chemical solvents, typically hydrocarbons, to the injected steam in order to obtain additional viscosity reduction. Examples include Liquid Addition to Steam For Enhancing Recovery (LASER, see, for example, U.S. Pat. No. 6,708,759) and Steam And Vapor Extraction processes (SAVEX, see, for example, U.S. Pat. No. 6,662,872). These processes use chemical solvents as an additive within an injection stream that is steam-dominated. Solvent-dominated recovery processes are a possible next step for viscous oil recovery technology. In these envisioned processes, chemical solvent is the principal component within the injected stream. Some non-commercial technology, such as Vapor Extraction (VAPEX, see, for example, R. M. Butler & I. J. Mokrys, J. of Canadian Petroleum Technology, Vol. 30, pp. 97-106, 1991) and Cyclic Solvent-Dominated Recovery Process (CSDRP, see, for example, Canadian Patent No. 2,349,234) use injectants that may be 100%, or nearly all, chemical solvent.

At the present time, solvent-dominated recovery processes (SDRPs) are rarely used to produce highly viscous oil. Highly viscous oils are produced primarily using thermal methods in which heat, typically in the form of steam, is added to the reservoir. Cyclic solvent-dominated recovery processes (CSDRPs) are a subset of SDRPs. A CSDRP is typically, but not necessarily, a non-thermal recovery method that uses a solvent to mobilize viscous oil by cycles of injection and production. Solvent-dominated means that the injectant comprises greater than 50% by mass of solvent or that greater than 50% of the produced oil's viscosity reduction is obtained by chemical solvation rather than by thermal means. One possible laboratory method for roughly comparing the relative contribution of heat and dilution to the viscosity reduction obtained in a proposed oil recovery process is to compare the viscosity obtained by diluting an oil sample with a solvent to the viscosity reduction obtained by heating the sample.

Although preferably a CSDRP is predominantly a non-thermal process in that heat is not used principally to reduce the viscosity of the viscous oil, the use of heat is not excluded. Heating may be beneficial to improve performance, improve process start-up, or provide flow assurance during production. For start-up, low-level heating (for example, less than 100° C.) may be appropriate. Low-level heating of the solvent prior to injection may also be performed to provide general flow assurance such as preventing hydrate formation in tubulars and in the reservoir. Heating to higher temperatures may benefit recovery.

In a CSDRP, a viscosity-reducing solvent is injected through a well into a subterranean viscous-oil reservoir, causing the pressure to increase. Next, the pressure is lowered and reduced-viscosity oil is produced to the surface through the same well through which the solvent was injected. Multiple cycles of injection and production are used. In some instances, a well may not undergo cycles of injection and production, but only cycles of injection or only cycles of production.

CSDRPs may be particularly attractive for thinner or lower-oil-saturation reservoirs. In such reservoirs, thermal methods utilizing heat to reduce viscous oil viscosity may be inefficient due to excessive heat loss to the overburden and/or underburden and/or reservoir with low oil content.

References describing specific CSDRPs include: Canadian Patent No. 2,349,234 (Lim et al.); G. B. Lim et al., "Three-dimensional Scaled Physical Modeling of Solvent Vapour Extraction of Cold Lake Bitumen", The Journal of Canadian Petroleum Technology, 35(4), pp. 32-40, April 1996; G. B. Lim et al., "Cyclic Stimulation of Cold Lake Oil Sand with Supercritical Ethane", SPE Paper 30298, 1995; U.S. Pat. No. 3,954,141 (Allen et al.); and M. Feali et al., "Feasibility Study of the Cyclic VAPEX Process for Low Permeable Carbonate Systems", International Petroleum Technology Conference Paper 12833, 2008.

The family of processes within the Lim et al. references describes embodiments of a particular SDRP that is also a cyclic solvent-dominated recovery process (CSDRP). These processes relate to the recovery of heavy oil and bitumen from subterranean reservoirs using cyclic injection of a solvent in the liquid state which vaporizes upon production. The family of processes within the Lim et al. references may be referred to as CSP™ technology.

In order to handle the host of challenges for a solvent-dominated injection operation, a methodology is needed to manage overall solvent injection, production, supply, and reuse. This challenge becomes increasingly complex as additional wells or pads are brought online. Optimally, the methodology should account for the fact that the scheduling of each well depends on the previous injection and production histories of the well, the injection and production rates of every other well in the field, the supply of solvent to the field, the value of each stream of components being injected and produced from that well, and the properties of the reservoir near the well and near the volume of the reservoir previously accessed by solvent.

Descriptions of solvent-dominated cyclic recovery processes (such as in Canadian Patent No. 2,349,234) refer to the general operation of a well for a solvent-dominated cyclic recovery process.

Other examples of cyclic oil recovery processes also exist, such as cyclic steam stimulation (e.g., U.S. Pat. No. 3,739,852) and cyclic steam injection (e.g., U.S. Pat. No. 3,434,544), but the value of the produced injectant (water in these cases) is less than the value of solvent, and thus, careful management of the produced injectant is not as important. Moreover, water can be stored as a liquid at atmospheric conditions, and therefore there is less incentive to minimize surface solvent storage.

The following additional references are mentioned but also do not describe a method of distributing a viscosity reducing solvent to an underground oil reservoir to minimize the net rate of solvent injection in order to minimize solvent storage.

United States Patent Publication No. 2008/0294484 describes an optimization system for transportation scheduling and inventory management of a bulk product from supply locations to demand locations.

U.S. Pat. No. 7,289,942 and International Patent Application No. WO 2006/044199A2 describe computer-implemented methods of analyzing performance of a hydrocarbon reservoir for the prediction of future production of hydrocarbon fluids from wells in the reservoir.

International Patent Application No. WO 2009/061433 describes a computer modeling application for finding the optimal solution to maximize total net margin, for the assignment of vehicles in an available fleet to transport cargo comprising one or more bulk products during a planning period.

U.S. Pat. No. 7,418,307 and United States Patent Publication No. 2008/0275796 describe methods for managing a component supply for the assembly of complex products.

U.S. Pat. No. 3,954,141 describes using a solvent which is gaseous at formation temperature and pressure or using a solvent being selected from the group consisting of paraffinic hydrocarbons having at least six carbon atoms, mono-nuclear aromatic hydrocarbons, naphtha, natural gasoline and mixtures thereof.

U.S. Pat. No. 7,546,228 teaches a computer-implemented method comprising the computer instantiating a first set of one or more random variables that model one or more uncertain time durations associated with one or more respective processes occurring in a first schedule, to determine one or more first instantiated values.

U.S. Pat. No. 7,478,024 describes a method of managing a fluid or gas reservoir that assimilates diverse data having different acquisition time scales and spatial scales of coverage for iteratively producing a reservoir development plan that is used for optimizing an overall performance of a reservoir.

There remains a need for reducing pipeline capacity, surface solvent storage, or underground solvent storage costs in solvent-dominated processes for recovering in situ hydrocarbons.

SUMMARY OF THE INVENTION

It is an object of the present invention to obviate or mitigate at least one disadvantage of previous methods.

According to one aspect, there is provided a method of distributing a viscosity reducing solvent to a set of wells terminating in an underground oil reservoir where the variation in the net solvent injection rate (for example $Q_{NET}$, of Eq. 3, described below) of the set of wells is minimized. The "net solvent injection rate" is the difference between the total solvent injection rate and the total solvent production rate from the set of wells on either an instantaneous or daily (or other time period) rate basis. Minimizing this variation can reduce costs associated with surface solvent storage, subsurface solvent storage, and solvent supply, since solvent supply is typically least expensive when supplied at or near a fixed rate. Aspects of this invention relate to the processes and parameters used to minimize the variation in the net solvent injection rate. One aspect relates to a method of operating well pairs to balance solvent supply with net solvent injected (for example, balancing $Q_{PIPELINE}$ and $Q_{NET}$, described below), potentially eliminating the need for, or reducing, surface storage facilities, which can be costly, especially when pressurization of the solvent above atmospheric pressure is required to store the solvent as a liquid at ambient temperatures. This method is particularly useful in solvent-dominated, cyclic or non-cyclic, viscous oil recovery processes where solvent is injected into a subterranean reservoir either in a series of cycles or continuously and a solvent/viscous oil blend is produced from the subterranean reservoir until the process is no longer economic.

In another aspect, there is provided a method of distributing a viscosity reducing solvent to a set a wells terminating in an underground oil reservoir, the method comprising: receiving the solvent; splitting a subset of wells in the set of wells into two or more groups where all wells in a group have similar injection cycle schedules; and injecting solvent using injection cycle schedules which are offset in time between groups so as to minimize fluctuations in an overall solvent injection rate to the set of wells.

According to another aspect, there is provided a method of reducing pipeline capacity, surface solvent storage, or underground solvent storage costs during operation of a solvent-dominated process for recovering hydrocarbons from an underground reservoir, the method comprising: (a) estimating solvent injection and production rates through wells terminating in the reservoir; (b) selecting, based on the estimates of step (a), an injection and production schedule that minimizes variation in a net solvent injection rate; and (c) implementing the selected schedule to recover the hydrocarbons.

Within this aspect of the invention, the following features may be present.

The net solvent injection rate may be based on a time period of at least twelve hours. The selected injection and production schedule may reduce the variation in the net solvent injection rate to an amount where an average daily difference between injected and produced solvent volumes from the set of wells is within 20% of an average difference over a time period of one month. The selected injection and production schedule may reduce the variation in the net solvent injection rate to an amount where an average hourly difference between injected and produced solvent volumes from the set of wells is within 50% of an average difference over a time period of one day. An injection and production schedule may be selected and used that minimizes variation in the net solvent injection rate to below 10% over a daily period. The process may be a cyclic solvent-dominated recovery process. The process may be a non-cyclic solvent-dominated recovery process.

The schedule may comprise injecting solvent into one well of a pair, while producing fluids from the other well in the pair. The schedule may comprise injecting solvent into one well of a pair at a daily rate of +/−10% of a daily rate of solvent simultaneously produced from the other well in the pair plus an amount of solvent supply from a solvent source constant to +/−10% on a daily basis. Wells of a pair may be separated from one another by a buffer zone for limiting well-to-well interaction. The method may be operated in a plurality of the well pairs.

The schedule may comprise injecting solvent into a first group of wells, while producing fluids from a second group of wells. The schedule may comprise injecting solvent into a first group of wells at a rate of +/−10% of a daily rate of solvent being simultaneously produced from a second group of wells plus an amount of solvent supply from a solvent source constant to +/−10% on a daily basis. The first and second well groups may be separated from one another by a buffer zone for limiting well-to-well interaction. The method may be operated in a plurality of the well groups.

Where the process is cyclic, the following features may be present. The schedule may comprise operating the wells in groups with offset injection schedules, wherein: wells within a first group have similar injection schedules; wells within a second group have similar injection schedules; and wells of the first group have injection schedules that are offset in time from the wells of the second group. The similar injection schedules may be where the injection schedules include injecting at approximately the same rates for approximately equivalent durations of time. The injection schedules that are offset in time may be where, for at least 10% of a time, the wells of the first group are injecting while the wells of the second group are not significantly injecting. The schedule may further comprise operating wells with offset production schedules, wherein: wells within the first group have similar production schedules; wells within the second group have similar production schedules; and wells of the first group have production schedules that are offset in time from the wells of the second group. The similar production schedules may be where the production schedules include producing at approximately the same rates for approximately equivalent durations of time. Production schedules that are offset in time is where, for at least 10% of a time, the wells of the first group are producing while the wells of the second group are not significantly producing.

Where the process is non-cyclic, the following features may be present. The schedule may comprise operating the wells in groups with offset injection schedules, by:

alternating between injecting and not significantly injecting into at least two groups of injection wells, wherein wells within a first group have similar injection schedules; wells within a second group have similar injection schedules; wells of the first group have injection schedules that are offset in time from the wells of the second group; and alternating between producing and not significantly producing in production wells that are distinct from the injection wells. The similar injection schedules may be where the injection schedules include injecting at approximately the same rates for approximately equivalent durations of time. The injection schedules that are offset in time may be where, for at least 10% of a time, the wells of the first group are injecting while the wells of the second group are not significantly injecting. The schedule may further comprise operating wells with offset production schedules, wherein: wells within the first group have similar production schedules, wells within the second group have similar production schedules; and wells of the first group have production schedules that are offset in time from the wells of the second group. The similar production schedules may be where the production schedules include producing at approximately the same rates for approximately equivalent durations of time. The production schedules that are offset in time may be where, for at least 10% of a time, the wells of the first group are producing while the wells of the second group are not significantly producing.

Not significantly injecting may be injecting less than 10% of a maximum injection rate in an injection cycle for the well. Not significantly producing may be producing less than 10% of a maximum injection rate in production cycle for the well.

The method may further comprise: (d) after a period of production, estimating, by field measurement, solvent injection and production rates into the wells terminating in the reservoir; (e) based on the estimates of step (d), selecting another injection and production schedule to minimize variation in the net solvent injection; and (f) using the another schedule to recover the hydrocarbons. The another schedule may differ from the schedule in a length of an injecting or production period, or in an injection or production rate. The method may further comprise: using different injection cycle lengths for at least two wells, to reduce the variation in the net solvent injection rate; using different production cycle lengths for at least two wells, to reduce the variation in the net solvent injection rate; using above-ground solvent storage to store solvent produced from the reservoir for reinjection; using a reservoir zone to store solvent, wherein the reservoir zone is one from which hydrocarbons have previously been produced; using a subsurface reservoir to store solvent, where the subsurface reservoir is one from which at least a fraction of initial in situ fluids has been recovered; limiting produced solvent volume by operating at a production pressure that is above the vapor pressure of the solvent to keep the solvent as a liquid and in the reservoir (such as when surface solvent storage is not available).

At least a portion of the injected solvent may supplied by a pipeline. At least a portion of the injected solvent may be progressively trucked-in and injected into the wells to produce hydrocarbons to reach plant capacity and produced solvent is recycled by balancing the number of injecting and producing wells such that solvent storage capacity is reduced to make up for interruptions in trucking.

The estimating step (a) may comprise collecting field measurements, such as from pilot or test wells. The estimating step (a) may comprise running a reservoir simulation. The estimating step (a) may comprise using a mathematical model.

The selecting step (b) may comprise using an optimization algorithm to select the schedule. The optimization algorithm may be set to: minimize the variation in the net solvent injection rate; minimize solvent storage volume; or minimize variation in solvent supply rate supplied by pipeline or trucking. The selection of step (b) may be made having regard to economic and/or technical constraints.

The solvent-dominated process may comprise injecting a fluid into the formation, the fluid comprising greater than 50 mass % of viscosity-reducing solvent. Immediately after halting injection of the viscosity-reducing solvent into the reservoir, at least 25 mass % of the injected solvent may be in a liquid state in the reservoir. In the solvent-dominated process, at least 25 mass %, or at least 50 mass %, of a viscosity-reducing solvent may enter the reservoir as a liquid. The solvent may comprise greater than 50 mass % of a $C_2$-$C_5$ paraffinic hydrocarbon solvent, greater than 50 mass % propane, greater than 70 mass % propane, greater than 20 mass % ethane, or $CO_2$.

The hydrocarbons may be a viscous oil having an in situ viscosity of at least 10 cP at initial reservoir conditions.

The method may be for reducing pipeline capacity. The method may be for reducing surface solvent storage. The method may be for reducing underground solvent storage costs.

The selection of step (b) may further comprise: where solvent supply capacity to the wells exceeds demand for solvent in the wells, selecting a schedule that produces at least one well of relatively lower efficiency at a lower rate than at least one well of relatively higher efficiency. The at least one well of relatively lower efficiency may be a well of lowest efficiency.

The selection of step (b) may further comprise: where demand for solvent in the wells exceeds solvent supply capacity to the wells, selecting a schedule that produces from the wells at full capacity during production.

The selection of step (b) may further comprise: where solvent supply capacity to the wells exceeds demand for solvent in the wells and above ground storage is at capacity, storing solvent in the at least one well of relatively lower efficiency.

In another aspect, there is provided a method of distributing a viscosity reducing solvent to a set a wells terminating in an underground oil reservoir, the method comprising: receiving the solvent; splitting a subset of wells in the set of wells into two or more groups where all wells in a group have similar injection cycle schedules; and injecting solvent using injection cycle schedules which are offset in time between groups so to minimize fluctuations in an overall solvent injection rate to the set of wells.

According to an aspect of the present invention, there is provided a method of maximizing a measure of profitability, under solvent constraints, during operation of a solvent-dominated process for recovering hydrocarbons from an underground reservoir, the method comprising: (i) estimating solvent injection and production rates through wells terminating in the reservoir; (ii) selecting, based on the estimates of step (i), an injection and production schedule that maximizes the measure of profitability within the solvent constraints; and (iii) implementing the selected schedule to recover the hydrocarbons, wherein the selection of step (ii) comprises: where a solvent supply capacity to the wells exceeds a demand for solvent in the wells, selecting a schedule that produces at least one well of relatively lower efficiency at a lower rate than at least one well of relatively higher efficiency.

Within this aspect of the invention, the following features may be present.

The measure of profitability may be oil production. At least one well of relatively lower efficiency may be a well of lowest efficiency. Where the demand for solvent in the wells exceeds the solvent supply capacity, the method may comprise selecting a schedule that produces from the wells at full capacity during production. Where the solvent supply capacity to the wells exceeds the demand for solvent in the wells and above ground storage is at capacity, the method may comprise storing solvent in the wells of relatively lower efficiency.

The process may be a cyclic solvent-dominated recovery process. The process may be a non-cyclic solvent-dominated recovery process.

The method may further comprise: (iv) after a period of production, estimating, by field measurement, solvent injection and production rates into the wells terminating in the reservoir; (v) based on the estimates of step (iv), selecting another injection and production schedule to minimize variation in the net solvent injection; and (vi) using the another schedule to recover the hydrocarbons.

The estimating step (i) may comprise collecting field measurements, such as from pilot or test wells. The estimating step (i) may comprise running a reservoir simulation. The estimating step (i) may comprises using a mathematical model.

The selecting step (ii) may comprise using an optimization algorithm to select the schedule. The selection of step (ii) may be made having regard to economic and/or technical constraints.

The solvent-dominated process may comprise injecting a fluid into the formation, the fluid comprising greater than 50 mass % of viscosity-reducing solvent. Immediately after halting injection of the viscosity-reducing solvent into the reservoir, at least 25 mass % of the injected solvent may be in a liquid state in the reservoir. In the solvent-dominated process, at least 25 mass %, or at least 50 mass %, of a viscosity-reducing solvent may enter the reservoir as a liquid.

The solvent may comprise greater than 50 mass % of a $C_2$-$C_5$ paraffinic hydrocarbon solvent, greater than 50 mass % propane, greater than 70 mass % propane, greater than 20 mass % ethane, or $CO_2$.

The hydrocarbons may be a viscous oil having an in situ viscosity of at least 10 cP at initial reservoir conditions.

Other aspects and features of the present invention will become apparent to those ordinarily skilled in the art upon review of the following description of specific embodiments of the invention in conjunction with the accompanying Figures.

BRIEF DESCRIPTION OF THE DRAWINGS

Embodiments of the present invention will now be described, by way of example only, with reference to the attached Figures, wherein.

DETAILED DESCRIPTION

The term "viscous oil" as used herein means a hydrocarbon, or mixture of hydrocarbons, that occurs naturally and that has a viscosity of at least 10 cP (centipoise) at initial reservoir conditions. Viscous oil includes oils generally defined as "heavy oil" or "bitumen". Bitumen is classified as an extra heavy oil, with an API gravity of about 10° or less, referring to its gravity as measured in degrees on the American Petroleum Institute (API) Scale. Heavy oil has an API gravity in the range of about 22.3° to about 10°. The terms viscous oil, heavy oil, and bitumen are used interchangeably herein since they may be extracted using similar processes.

In situ is a Latin phrase for "in the place" and, in the context of hydrocarbon recovery, refers generally to a subsurface hydrocarbon-bearing reservoir. For example, in situ temperature means the temperature within the reservoir. In another usage, an in situ oil recovery technique is one that recovers oil from a reservoir within the earth.

The term "formation" as used herein refers to a subterranean body of rock that is distinct and continuous. The terms "reservoir" and "formation" may be used interchangeably.

By "cyclic" it is meant that any given well is intended to be used as both an injection well for injecting fluids into an underground reservoir and as a production well for producing fluids from the reservoir. By "non-cyclic" it is meant that wells are not used for both injecting fluids into an underground reservoir and producing fluids from the reservoir.

"Components of interest" means components found in situ in the reservoir or components injected into the reservoir during the life of the operation, including but not limited to solvent, oil, water, and methane.

One embodiment relates to a method for operating a solvent-dominated, cyclic or non-cyclic, oil recovery process using a liquid-phase or supercritical-phase injectant in order to minimize surface solvent storage while maintaining economic operating conditions.

Solvent-dominated, non-cyclic recovery processes to which embodiments of the instant invention could be applied include, for instance, a heated solvent process using a SAGD-type well configuration, as described in Canadian Patent Number 2,351,148 to Nenniger et al.

Embodiments of the instant invention could also be applied to Solvent-Assisted Steam-Assisted Gravity Drainage (SA-SAGD, described for instance in U.S. Pat. No. 6,708,759 to Leaute et al.), Liquid Addition to Steam for Enhanced Recovery (LASER, described for instance in Canadian Patent No. 1,246,993 (Vogel)), and solvent flooding (U.S. Pat. No. 4,510,997 to Fitch et al.).

Solvent-dominated, cyclic recovery processes to which embodiments of the instant invention could be applied include, for instance, CSP™ processes, referred to above. Embodiments of the invention could also be applied to solvent-dominated, non-cyclic recovery processes, for instance, VAPEX processes, referred to above.

Figure 1:
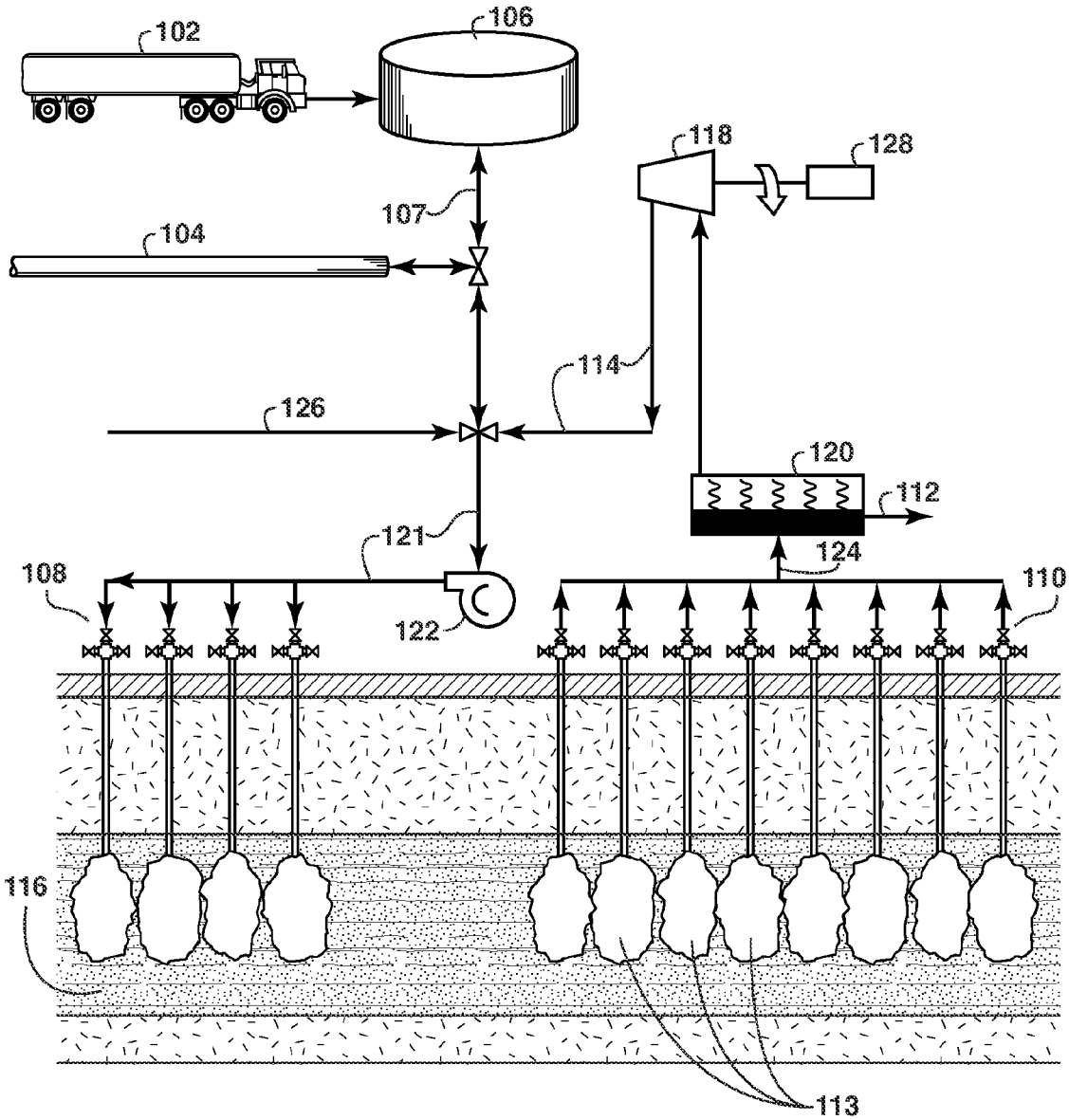
FIG. 1 is an example of a solvent supply, injection, and production system for a solvent-dominated cyclic oil recovery operation.

To manage solvent for a solvent-dominated, cyclic or non-cyclic, operation in a field, a solvent supply, injection, and production system is required. An example of such a system is illustrated in FIG. 1. Solvent can be brought to the field from an external source by trucks (102) and/or a pipeline (104) and injected into wells designated as injector wells (108) in FIG. 1. Prior to injection, solvent may be stored in a surface storage tank (106). Injector wells can be switched to production in the case of a cyclic operation, becoming producer wells (110) after a suitable bank of solvent (113) has been placed in the reservoir (116). From the produced fluids (124) of the producer wells, the produced solvent may be separated from the oil (112), recompressed, and reused for reinjection (114) into the reservoir (116). The compressor (118), separator (120), injection pump (122), power supply (128) and flowline for secondary solvent components (126), diluent for example, are also illustrated. In a cyclic process, once a sufficient amount of production has occurred, wells can be switched back to injection, becoming injector wells. In a cyclic process, this switching between injection and production modes for a given well occurs repeatedly.

FIG. 1 also shows the flowlines within the solvent supply, injection, and production system. In FIG. 1, the lines with arrows indicate the flow direction within flowlines that connect the components of system. For some flowlines, there are double-headed arrows, which indicate the fluid may flow either direction. The flowlines are an injection flowline (121) flowing at rate $Q_{INJECT}$ through injection pump (122), a solvent recycle flowline (114) flowing at rate $Q_{PRODUCE}$, a pipeline supply line (104) flowing at rate $Q_{PIPELINE}$, a flowline delivering secondary solvent components (126) at rate $Q_{SECONDARY}$, and a line (107) making deposits to or withdrawing solvent from tank (106) at rate $Q_{STORAGE}$. The rate of solvent injection into the set of wells (121) is therefore given by, $$Q_{INJECT}=Q_{PRODUCE}+Q_{PIPELINE}+Q_{SECONDARY}+Q_{STORAGE}. \quad (1)$$

Depending on whether the pipeline (104) is delivering solvent to or carrying solvent from the field operation, $Q_{PIPELINE}$ may be positive (delivering solvent to field) or negative (removing solvent from field). Depending on whether the tank (106) is supplying solvent to or accepting solvent from the field operation, $Q_{STORAGE}$ may be positive (supplying solvent to field) or negative (accepting solvent from field). If no secondary components are needed, Eq. (1) becomes, $$Q_{INJECT}=Q_{PRODUCE}+Q_{PIPELINE}+Q_{STORAGE}. \quad (2)$$

Because the produced solvent may be recycled, it is useful to frame the discussion of solvent supply to the field in terms of "net solvent," which is given by the difference between the injected and produced solvent rates, $$Q_{NET}=Q_{INJECT}-Q_{PRODUCE}=Q_{PIPELINE}+Q_{STORAGE}. \quad (3)$$

Figure 2A:
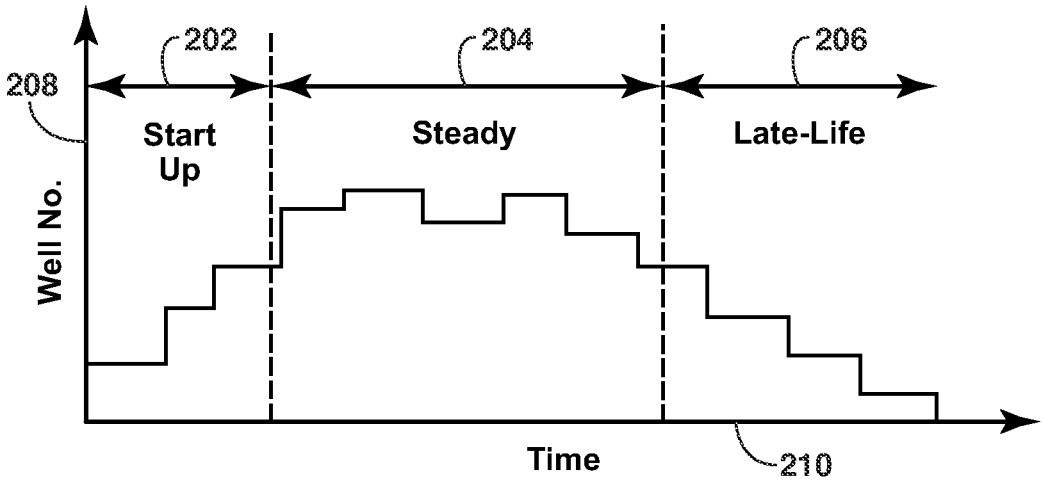
FIG. 2A is a graph showing a conceptual active well count history of a solvent-dominated cyclic oil recovery operation.
Figure 2B:
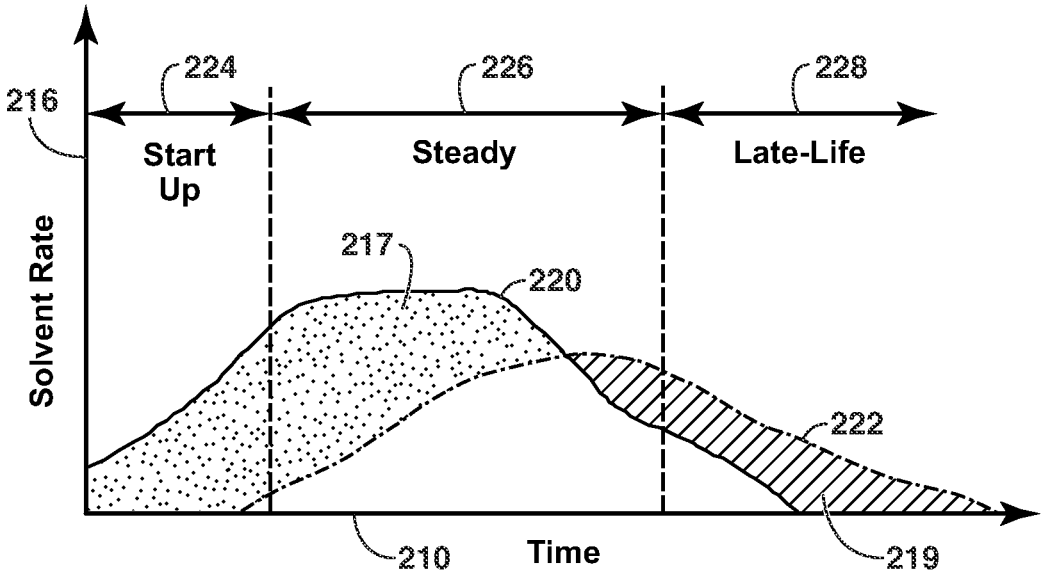
FIG. 2B is a graph showing conceptual solvent demand of a solvent-dominated cyclic oil recovery operation.

The life of a field operated with a solvent-dominated cyclic process can be divided into the following three phases: start-up (202), steady-state (204), and late-life (206) as illustrated in FIG. 2A and FIG. 2B. FIG. 2A is a plot of the active number of wells in the field operation (208) versus time (210). As shown in FIG. 2A, the number of active wells generally increases during the start-up phase, is generally about constant during the steady-state phase, and generally decreases during the late-life phase of the field operation.

FIG. 2B is a plot of solvent rate (216) versus time (210) for both injected solvent $Q_{INJECT}$ (220) and produced solvent $Q_{PRODUCE}$ (222). The difference between the two quantities is the net solvent, $Q_{NET}$. As shown in FIG. 2B, at startup (224), new wells are put into operation and there is a net positive demand for solvent as indicated by the shaded area (217). At first, no wells are producing ($Q_{PRODUCE}=0$). Therefore, $Q_{NET}>0$, and all injected solvent is supplied by pipeline and/or storage. By Eq. 3, $$Q_{NET}=Q_{INJECT}=Q_{PIPELINE}+Q_{STORAGE}>0. \quad (4)$$

At some point during the start-up phase of the field operation, some wells do begin producing ($Q_{PRODUCE}\neq 0$), but they still do not provide enough solvent to supply the injection wells. Therefore, make-up solvent must continue to be supplied by pipeline and/or from storage, and the full expression describing the net solvent demand is Eq. 3 (all terms non-zero). But, if storage has already been exhausted and has not been refreshed ($Q_{STORAGE}=0$), then by Eq. 3, $$Q_{NET}=Q_{INJECT}-Q_{PRODUCE}=Q_{PIPELINE}>0. \quad (5)$$

During the steady-state period (226), the number of active wells remains roughly constant, although it may deviate some. For much of the steady-state period, the net solvent demand $Q_{NET}$ may be continue to be similar to the net solvent supply available from the pipeline and/or storage tanks (refreshed periodically with trucking of solvent) as in Eq. 3. As the relative proportion of the active wells that are producers increases, less and less solvent may need to be supplied by pipeline. At some point the amount of solvent that is recycled may exactly equal the amount required for injection, $$Q_{NET}=Q_{INJECT}-Q_{PRODUCE}=0. \quad (6)$$

During the late-life period (228), there is a surplus of solvent, ($Q_{PRODUCE}>Q_{INJECT}$) as operations wind-down and wells become inactive. The net demand for solvent is negative (area shaded by (219)) and is given by, $$Q_{NET}=Q_{INJECT}-Q_{PRODUCE}<0. \quad (7)$$

The direction of flow in the pipeline may then be reversed ($Q_{PIPELINE}<0$) and solvent may be sent by pipeline to a facility for resale or to a new site for reuse.

Important challenges in all three phases of a solvent-dominated cyclic recovery process are minimizing the capital costs, operating costs, and supply costs. In particular, important challenges are minimizing costs related to pipeline capacity, surface solvent storage, and underground solvent storage. Surface storage capacity is costly, especially when pressurization of the solvent above atmospheric pressure is required to store the solvent as a liquid at about 20° C. Therefore, it is desirable to minimize the volume of the costly solvent storage tank (106). Designing the capacity of the pipeline to minimize cost is also important. This is especially true since the total field solvent demand ($Q_{NET}$) may vary over the operating life of the field, but pipeline solvent supply is typically near a uniform rate. Therefore, it is desirable to minimize the variation of the pipeline supply rate ($Q_{PIPELINE}$) over time. When the solvent production exceeds the solvent injection demand, the excess solvent may be stored on the surface and/or underground. Although underground storage potentially has lower capital costs than surface storage (because injection wells already exist), there is a risk that not all injected solvent may be recovered, increasing operational cost. Stored solvent is also effectively a capital cost. Operationally, solvent storage may be particularly challenging to manage when the injection rates and production rates of wells differ dramatically. For instance, solvent injection rates can be 1 to 20 times higher than solvent production rates. In addition, for a cyclic process, individual well injection rates can vary dramatically in any given cycle (i.e., cycling between no injection and a maximum injection rate) and over the life of the well (i.e., injection rates can vary from one cycle to another).

In one embodiment, solvent is distributed to a set of wells terminating in an underground oil reservoir, where the operation is managed to minimize the surface solvent storage by minimizing the variation in the net solvent injection rate over the set of wells, into the reservoir (see FIG. 3, described further below), over a certain period of time. The rate of withdrawal/deposition from storage is given by rearrangement of Eq. 3, $$Q_{STORAGE}=Q_{INJECT}-Q_{PRODUCE}-Q_{PIPELINE}-Q_{NET}-Q_{PIPELINE}. \quad (8)$$

Eq. 8 is applicable over any period of time. The volume of solvent storage required during a time period ($\Delta t$) of deposition or withdrawal is a function of the average deposition or withdrawal rate during the time period times the length of the time period, $$V_{STORAGE}=Q_{STORAGE}\Delta t. \quad (9)$$

The rate over a time period times the length of the time period is often called the cumulative volume. For example, if a withdrawal rate of 100 $m^3$ per day is expected over a period of 7 days, a tank containing at least 700 $m^3$ of solvent is required if no other solvent is delivered to the tank. If a deposition rate of 50 $m^3$ per day is expected over a period of 10 days, then a tank containing at least 500 $m^3$ of empty volume (ullage) is required.

It is important to note that if a time period includes both a deposit and a withdrawal from storage, the amount of storage required to satisfy the volume needs during the time period is the volume of required fluid or required ullage, whichever is larger. Those skilled in the art will recognize that the volume of storage required for N time periods, consisting of both withdrawals and depositions, may be expressed mathematically as the maximum value of the absolute value of the cumulative volume of the depositions/withdrawals for all time periods $\Delta t$.

$$V_{STORAGE}=\max\left(\mathrm{abs}\left(\sum_{i=1}^{j} Q^{i}_{STORAGE}\Delta t^{i}\right)_{j=1}^{N}\right). \quad (10)$$

Those skilled in the art will recognize that Eq. 10 may be equivalently expressed using other means, including integral calculus. For purposes of understanding embodiments of the invention, it is sufficient to understand that the volume of required storage depends directly on the rates and durations of withdrawals from, and depositions, to storage.

Figure 2C:
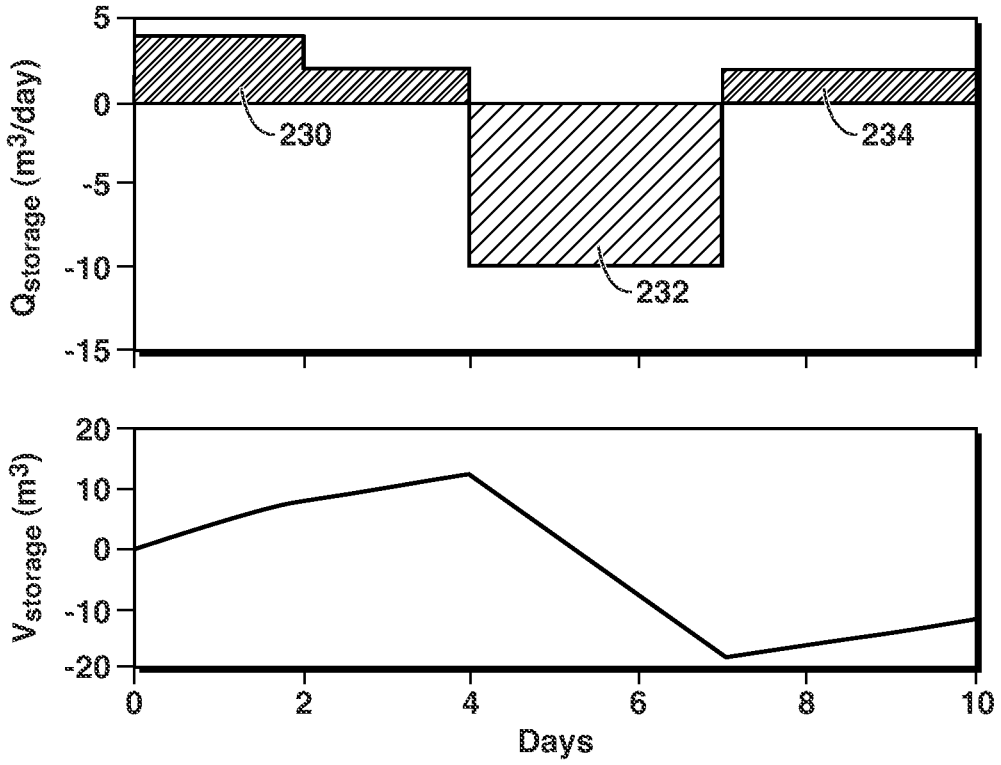
FIG. 2C illustrates a graph of the rate of solvent deposition in, or withdrawal from, storage versus time and a graph of cumulative volume deposited in, or withdrawn from, storage versus time.

FIG. 2C illustrates a time series of withdrawing solvent from the storage tank (230), depositing solvent to the tank (232), and then further withdrawing solvent from the tank (234). The top portion of FIG. 2C shows how the rate of deposition in ($Q_{STORAGE}<0$) for withdrawal from ($Q_{STORAGE}>0$) the tank changes over time. The bottom portion of FIG. 2C shows the cumulative volume deposited ($V_{STORAGE}<0$) or withdrawn ($V_{STORAGE}>0$) since the beginning of the time period. In FIG. 2C, the maximum demand on the tank's capacity to supply stored solvent is $V_{STORAGE}=12$ $m^3$ and the maximum demand on the tank's capacity to hold deposited solvent is 18 $m^3$ ($V_{STORAGE}=-18$ $m^3$). Therefore, a tank of at least 18 $m^3$ is required for this 10-day time period assuming no other deliveries of solvent to the tank. Those skilled in the art will recognize that the cumulative volume plotted in the lower portion of FIG. 2C is the area under the curve of the upper figure, also known in calculus as an integral.

Since solvent supply can be trucked in or brought in via a supply pipeline at a near constant daily rate (for example, $Q_{PIPELINE}$), operating the process such that the net injected solvent ($Q_{NET}$) into the underground oil reservoir matches, or is close to, this constant daily supply rate with minimal variation will minimize the surface solvent storage required. For a cyclic operation, each well operates in a cyclic or periodic fashion, injecting solvent during one portion of its cycle and producing solvent during another portion.

While the term "minimize[ing]" is used herein, its use is not intended to imply that full minimization is required. That is, advantages may be achieved by reducing, without fully mathematically minimizing, the value at issue. Likewise, the term "optimize[ing]", is not intended to imply full mathematical optimization. Mathematical methods for minimizing include, for example, downhill simplex, conjugate gradient, Monte Carlo based, genetic algorithms, simulated annealing, and other methods well known in the art. In mathematical optimization algorithms an objective variable (for example, solvent storage requirement or oil production), is minimized or maximized subject to particular constraints (for example, bounds on reasonable values of factors affecting the objective variable).

As used herein the expression "minimizing the variation in the net solvent injection rate" has the same meaning as "improving the net solvent rate uniformity".

In order to design an operational strategy that minimizes the variation in net solvent injected, ($Q_{NET}$) and therefore minimizes the solvent storage and pipeline supply variation, it is useful to predict all of the terms of Eq. 3 as a function of time. More precisely, the aim is to calculate the net solvent injected as a function of time, $$Q_{NET}(t)=Q_{INJECT}(t)-Q_{PRODUCE}(t)-Q_{PIPELINE}(t)+Q_{STORAGE}(t), \quad (10)$$

from the individual injection rates and production rates of all the wells in the set of wells, and to further analyze the variance of $Q_{NET}(t)$. The net solvent injection rate of the field may be computed from the sum over all the set of individual wells, $$Q_{NET}(t) = \sum_{SET} q_{INJECT}(t) - \sum_{SET} q_{PRODUCE}(t), \quad (11)$$

The injection rate $q_{INJECT}(t)$ and production rate $q_{PRODUCE}(t)$ vs. time for a well may be referred to together as a "well profile." One measure of variance is the maximum net injected solvent volume during a time period divided by the average net injected solvent volume over the same time period, $$\text{variance} = \frac{\max[Q_{NET}(t)]}{\text{average}[Q_{NET}(t)]}, \quad (12)$$

Those skilled in the art will appreciate that there are many alternative definitions of variance; for example, measures of variance that use the concept of standard deviation, make use of different length time periods, or are expressed in terms of volume rather than rate. The following non-limiting quantitative examples of minimizing are provided. In a first example, applying directly Eq. 12, it may be desirable to minimize the variation in net solvent injection rate to below 10% over a daily period. In another example, it may be desirable that the selected injection and production schedule reduce the variation in the net solvent injection rate to an amount where an average or maximum daily difference between the injected and produced solvent volumes from the set of wells is within 20% of an average difference over a time period of one month. In a further example, it may be desirable that the selected injection and production schedule reduce the variation in the net solvent injection rate to an amount where an average hourly difference between the injected and produced solvent volumes from the set of wells is within 50% of an average difference over a time period of one day. Relatively speaking, large variances for short periods of time may be acceptable because they do not result in large solvent storage demands, but over longer periods of time the average variance should be smaller. Variances over hourly periods such as twelve hours, the length of an oilfield worker shift, may be the most practical time period in some instances.

Figure 3:
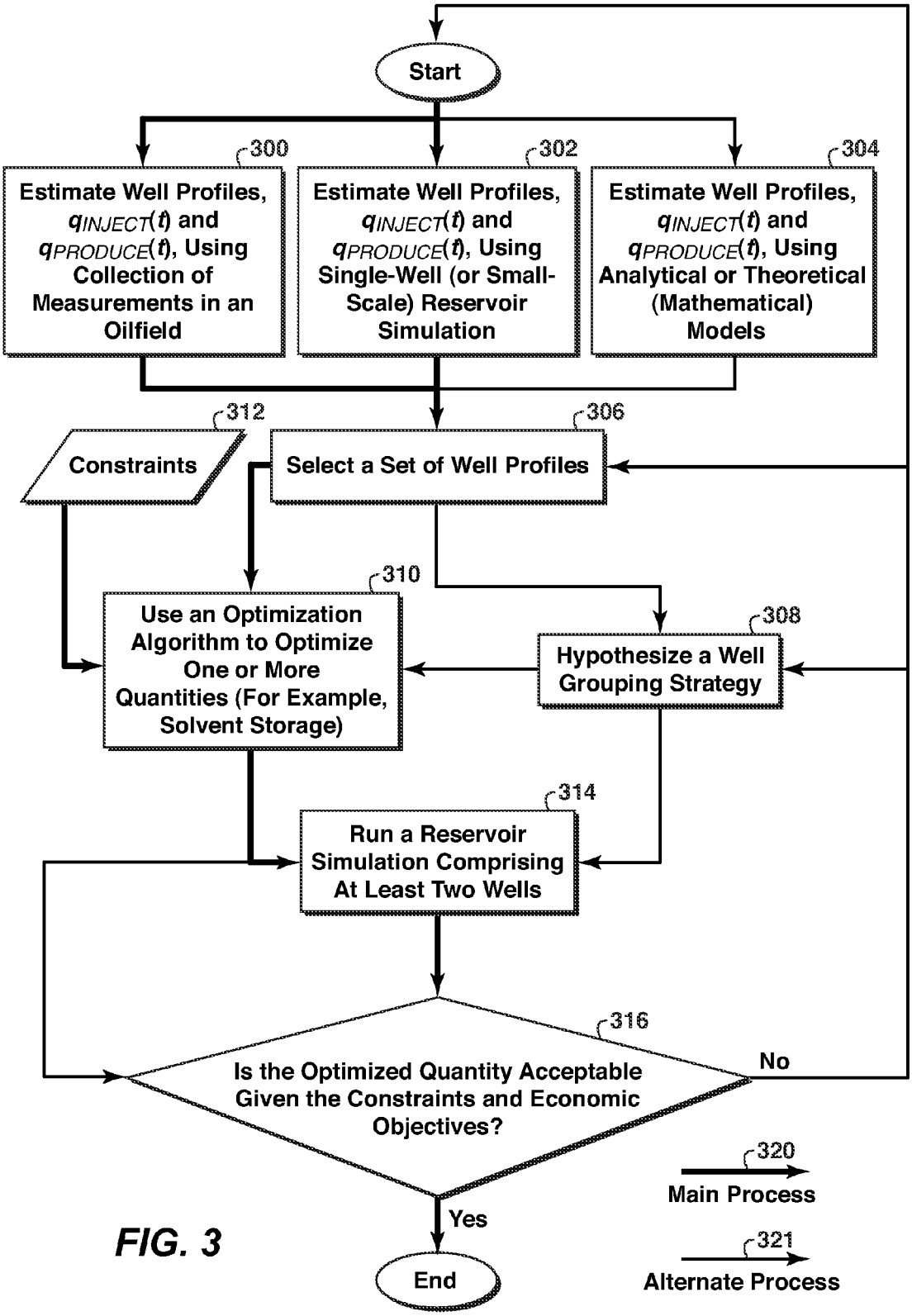
FIG. 3 is a flow chart of a system for developing an operational schedule in accordance with a disclosed embodiment.

Computer simulation may be used to design solvent volume management schemes for a set of injecting and producing wells. More specifically, reservoir simulation, when combined with an optimization algorithm, may be a particularly effective tool for designing solvent volume management schemes. With reference to FIG. 3, to balance the net solvent injected into a set of wells, a computer simulation procedure may be used to optimize the process in which the computer simulation procedure may comprise steps that use a reservoir simulator and/or an optimization algorithm, or "scheduler".

FIG. 3 is a flow chart of a system for developing an operational schedule in accordance with a disclosed embodiment. The first step is to generate well profile estimates which may include "estimating solvent injection and production rates". The term "rate" as used herein may be an instantaneous rate or a rate over a time period (i.e. estimating a volume injected or produced over a time period). The well profiles may be generated using field measurements (300) of existing wells (perhaps pilot or test wells), computer reservoir simulation (302), and/or other analytical or theoretical methods (304). One embodiment is denoted as the "Main Process" (320) and alternate embodiments are denoted as "Alternate Process" (321). For now, discussion of steps (300) and (304) is excluded. In the absence of actual field data (300), the preferred starting step is step (302), the prediction of well profiles using simulation.

The reservoir simulator (302) may be used to predict one or more of:

individual well injection rates vs. time, $q_{INJECT}(t)$;

individual well production rates vs. time, $q_{PRODUCE}(t)$;

average rates $q_{INJECT}$ and $q_{PRODUCE}$ over a time period; and total volumes $v_{INJECT}$ and $v_{PRODUCE}$ over a time period, for one or more of the components in the simulation. The primary component of interest is solvent.

The next step is to select a set of the generated profiles (306). The selection may be based on judgment of which profiles are likely to form optimal groups or which profiles are most certain. If no judgment is made, the set of profiles may consist of all the generated profiles.

While it possible to design well grouping strategies that minimize the variation in the net solvent injected without optimization, it is preferable to instead do so with the aid of computer-based reservoir simulation and optimization algorithms. After selecting a collection of well profiles (306), the preferred step (310) is to use an optimization algorithm to minimize the variation in time of the net solvent injected. However, it is acceptable to hypothesize a well grouping strategy (308) without the aid of optimization.

The optimization algorithm (310), also called a "scheduler," may be used to minimize the variation in time of the net solvent injected into the set of wells by taking the selected set of well profiles (306) for one or more of the individual wells in the set of wells and scheduling the wells using one of more of the following optimization methods: operating wells in a group as a unit, offsetting the injection start-up dates for one or more wells, varying the injection cycle length for one or more wells, varying the idling or soak period between injection and production cycles for one or more wells, varying the production cycle length for one or more wells, varying the idling or soak period between production and injection cycles for one or more wells, using idling wells to store solvent, recycling the produced solvent from any well to be reinjected into any well using separation and recompression facilities, using above ground storage capacity, or using depleted reservoirs for solvent storage underground. The optimization algorithm observes a set of constraints (312) that may include economic and technical constraints. Economic constraints may include capacity costs or production yields. Technical constraints may include limits on pipeline or storage capacity, for example.

Whether or not the well grouping strategy is identified with or without optimization, it may be useful to test the grouping strategy using reservoir simulation comprising at least two wells (314). The optimization algorithm treats each well's profile as independent of every other well's profile. In actual field operations, this not true once wells begin to interact. A reservoir simulator can account for the interdependent nature of the wells' profiles. The field-wide net solvent injected predicted during step (314) is typically more trustworthy than that predicted by the optimization tool during step (310). However, it may also be appropriate to proceed from step (310) directly to step (316).

After the final simulation is complete, an assessment is made as to whether the optimization objectives are achieved. FIG. 3 states the optimization objective as obtaining an optimized quantity that is acceptable given the constraints (312) and other economic objectives. For example, one optimization objective may be that the variation in the net solvent injected is low (316). Other objectives may include ensuring that the surface solvent storage is minimized, the underground storage is minimized, or that the variation in the pipeline supply is acceptable.

If the objectives are not met, new well grouping strategies may be identified (308), new well profile selections may be repeated (306), or new well profile estimations may be carried out via new measurement (300), simulation (302), or calculation (304). In all three cases, optimization (310) may be repeated using the same or different constraints (312). If the objectives are met, the selection process is terminated.

An alternative embodiment is to use field data to estimate well profiles (300) and subsequently minimize the variation in the net solvent injection rate or other quantity. Field measurements may include one or more of: the injection rates and compositions, production rates and compositions, as well as durations of injection, production, and idling times. This alternative embodiment may also be used in conjunction with the computer simulation approach (302) to generating well profiles as previously described.

An alternative embodiment uses analytic models to estimate well profiles (304) and subsequently minimize the variation in the net solvent injection rate. This alternative embodiment may also be used in conjunction with either the computer simulation approach to estimating well profiles (302) or the field data approach to estimating well profiles (300) as previously described.

Well Grouping for Largely Non-Cyclic and Largely Cyclic Processes

Figure 4A:
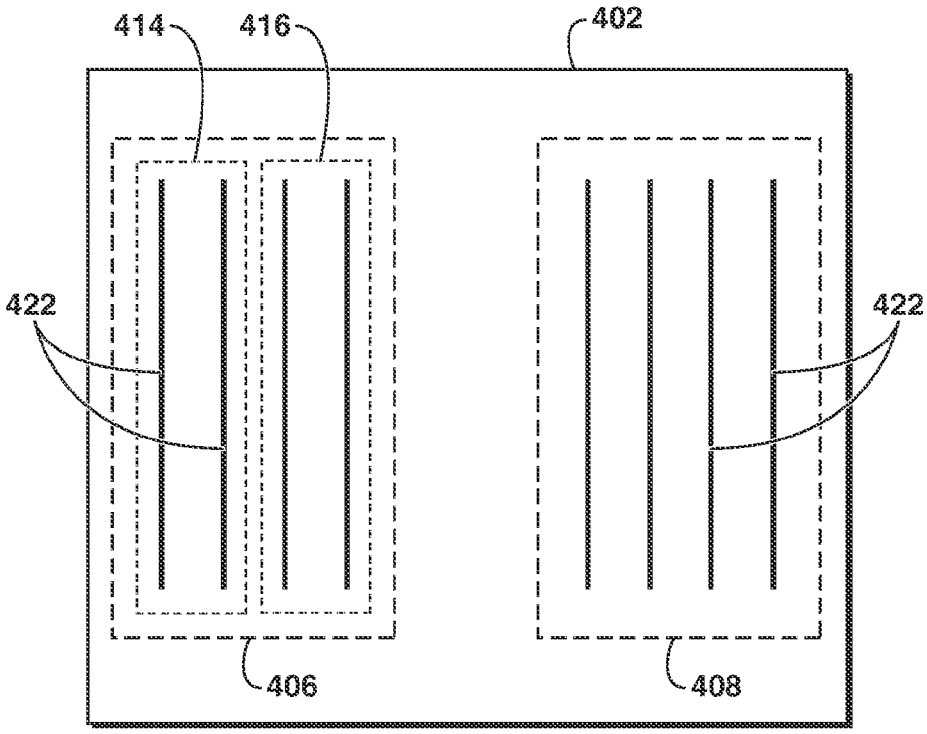
FIG. 4A is an example of a well grouping in accordance with a disclosed embodiment.
Figure 4B:
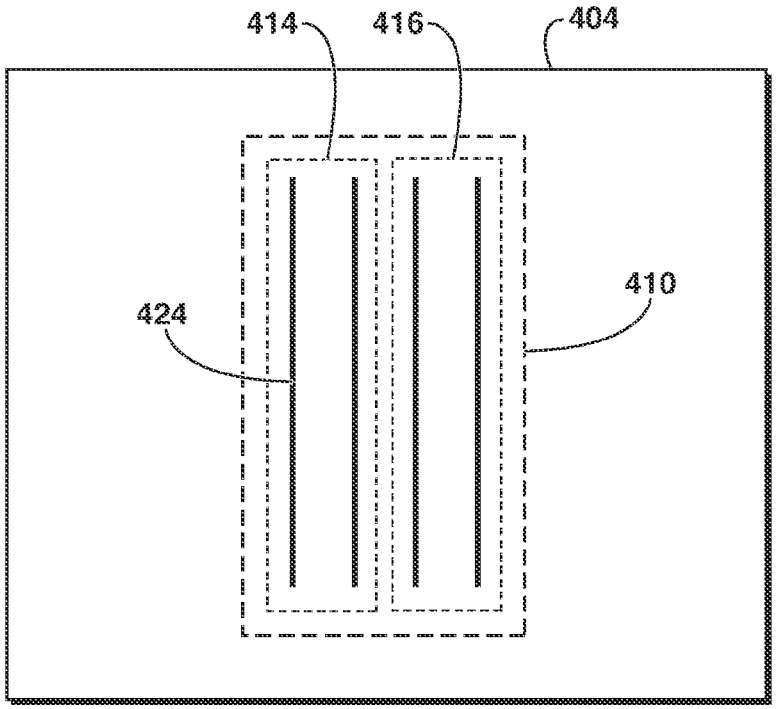
FIG. 4B is an example of another well grouping in accordance with a disclosed embodiment.

To minimize the complexity of managing a large number of wells in a set of wells, two embodiments of a strategy are shown in FIG. 4A and FIG. 4B. With reference to FIG. 3, these embodiments follow a path through one or more of (300), (302), and (306), and then (306) and (308). FIG. 4A illustrates a grouping strategy for a set of wells that are operated in a largely non-cyclic manner. FIG. 4B illustrates a grouping strategy for set of wells that are operated in a largely cyclic manner.

In FIG. 4A, a set (402) of eight wells (422) may be divided into two subsets of wells (406, 408). The first subset (406) comprises at least two wells from the set of wells where each well cycles between injecting solvent and not significantly injecting solvent. "Not significantly injecting" solvent means injecting less than 10% (including 0%) of a maximum injection rate in a cycle for a well. "Not significantly producing" fluids means producing less than 10% (including 0%) of a maximum production rate in a cycle for a well.

For example, each well cycles between a period of injection and a period of idling, as in a VAPEX recovery process employing solvent vapor injection wells and solvent/oil production wells. The second subset (408) comprises at least two wells from the set of wells where each well cycles between producing fluids and not significantly producing fluids. A method may be employed where the first subset of wells (406) is further split into two or more groups (414, 416) where all wells in a group have similar injection cycle schedules, and solvent is injected into the wells in the first subset (406) using injection cycle schedules which are offset in time between groups so as to minimize fluctuations in the overall solvent injection rate to the set of wells (402). A "similar injection cycle schedule" means that the wells are all injecting at approximately the same rates for approximately equivalent durations of time. Thus, the composition of the injectant, rate of injection, and duration of injection are approximately equivalent for each similar injection cycle schedule. "Approximately the same" and "approximately equivalent" means about ±50%, or more preferably ±20%, or most preferably ±10%. Because a "well profile" includes both the injection and production schedule, wells with a similar injection cycle schedule will have a similar well profile unless the idle periods differ substantially. In the embodiment of FIG. 4A, the groups of wells may be operated such that the starting time of a given injection cycle for one group of wells is offset from the starting time of one of the other groups of wells. This strategy assists in the overall balance of net solvent injected ($Q_{NET}$) over the set of wells.

Grouping wells may also help in managing the overall oil recovery from the reservoir. Grouping allows for wells undergoing similar operations (injection, production, idling) and in a similar stage of life (early operation, late-life operation, etc.) to be placed physically in proximity to one another. This proximal placing of wells undergoing similar operation may be preferred, especially early in the process, since it can prevent adjacent wells from being offset in such a way that one well is injecting solvent while an adjacent well is producing fluids from the reservoir. If one well is injecting solvent while an adjacent well is producing fluids, a large pressure gradient between the two wells is created, potentially leading to undesired early breakthrough of solvent from one well to another, decreasing the overall efficiency of the process and reducing the potential overall oil recovery.

In an alternate embodiment illustrating a grouping strategy for a set (404) of four wells (424) that are operated in a largely cyclic manner, the two subsets may have one or more wells in common as shown in FIG. 4B. FIG. 4B shows that all wells are common between the two subsets and are shown as one combined subset (410). Therefore, all the wells cycle between significantly injecting solvent and significantly producing solvent/oil. Such a grouping strategy is appropriate for a process where the wells are largely cyclic, for example CSP™ processes. In FIG. 4B, the combined subsets are further split into two groups (414, 416). As in the example for a largely non-cyclic process, all wells in a group have similar injection cycle schedules. However, because the injection wells are also producer wells, they also have similar production schedules. The injection and production schedules of the two groups are offset so that the variation in the net solvent injection rate ($Q_{NET}$) is minimized.

Solvent Management via Balancing Strategy

Figure 5:
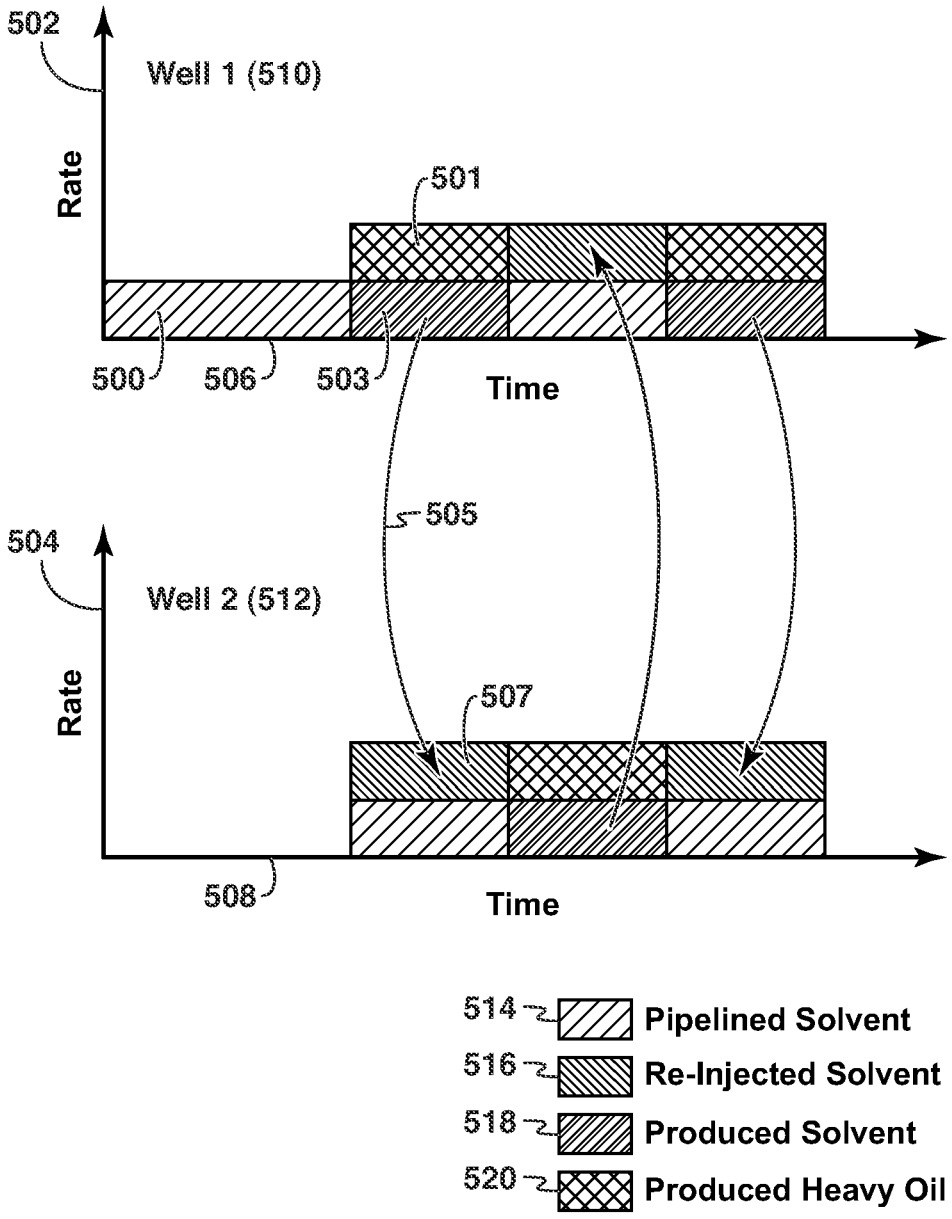
FIG. 5 is an example of an operating methodology in accordance with a disclosed embodiment.

An alternative to the preferred operating methodology presented in FIG. 3, where a computer simulation is used during steps (302), (310), and (314) to manage the net injected solvent, is a simpler pair balancing methodology, an example of which is presented in FIG. 5. With reference to FIG. 3, the methodology of FIG. 5 follows a path through (304), (306), and (308). The pair balancing methodology is a method where the rate of withdrawal or deposition to storage is always zero (or near zero). Therefore, Eq. 8 describes the pair balancing methodology. Setting $Q_{STORAGE}=0$ in Eq. 8 shows that the net solvent injected is therefore equal to the pipeline supply of solvent, $$Q_{NET}=Q_{PIPELINE}, \tag{14}$$

and that the injected solvent equals the solvent supplied by pipeline plus the produced (recycled) solvent, $$Q_{INJECT}=Q_{PIPELINE}+Q_{PRODUCE}. \tag{15}$$

FIG. 5 shows two rate (502 and 504) versus time (506 and 508) plots, one each for Well 1 (510) and Well 2 (512). In this configuration, each well belongs to a pair. In the simplest case, a well pair comprises two wells. However, a well pair could comprise one longer well paired with, for example, two shorter wells. Other pairings are also possible and will be obvious to those skilled in the art. For instance, instead of pairing wells, well groups may be paired. In FIG. 5, the fluid volume types are pipelined solvent (514), re-injected solvent (516), produced solvent (518), and produced heavy oil (520). Volume is equal to the rate times the time and may be thought of visually as the area formed by the shaded boxes. In each pair at any given time, after the initial injection into the first well, one well is used to inject solvent into the reservoir while one well is simultaneously producing fluids from the reservoir. The injected solvent in the injection well is supplied by a near constant solvent supply plus the solvent produced from its paired-corresponding producing well. By Eq. 14, if the pipeline solvent supply is near-constant, then the net solvent injected is also near-constant. In this way, the net injected solvent into any pair of wells is balanced with the incoming solvent supply, effectively eliminating, or reducing, the variation in the net injected solvent into the pair of wells. In previously mentioned embodiments, at downhole conditions, the injection rate of fluids into a well at a given stage in the development is allowed to exceed the production rate of fluids from a well at a similar stage in development, but in this embodiment, to balance the net injected solvent between a pair of wells, the injection rate of solvent into a given well can be reduced sufficiently so as to match the production of fluids from the corresponding well in its pair plus a near constant supply. The injection and combined solvent supply (recycled plus external) rates need not match exactly to effectively obtain a near-zero solvent storage operation. For example, the schedule may comprise injecting solvent into one well of a pair at a rate substantially equal (+/−10% daily) to a rate of solvent simultaneously produced from the other well in the pair plus a substantially constant (+/−10% daily) solvent supply from a solvent source. Thus, using this methodology reduces the complexity of solvent management and the need for surface solvent storage but has the potential to reduce the rate of solvent recovery from an individual well since the injection rates must be reduced to more closely match the production rates.

An example of this embodiment is given for a solvent-dominated cyclic injection process as follows. The initial solvent injection volume (500) in the first cycle of Well 1 in the well pair is delivered by pipeline at a rate of 100 $m^3$/day. Next, injection into Well 1 ceases and Well 1 is switched to production. Well 1 produces a volume of viscous oil (501) and a volume of solvent (503) which is transported (505) to Well 2, where the volume of solvent (507) is re-injected. This method requires that the injection and production durations and liquid rates at downhole conditions are approximately constant and approximately equal, as shown in FIG. 5. Thus, in the example in FIG. 5 for a cyclic process, after the initial injection in the first cycle into Well 1, the solvent injection rate during injection in Well 2 is 200 $m^3$/day (100 $m^3$/day from the solvent supply and 100 $m^3$/day from the produced solvent from Well 1). The process continues for additional cycles. The total liquid production rate in this embodiment may vary since the oil production rate is not necessarily constant.

Computer simulation (such as that in step (314)) has confirmed that the hypothesized well balancing strategy (308) just described is an effective mechanism for obtaining a zero solvent strategy without impacting production in a major way.

Figure 6:
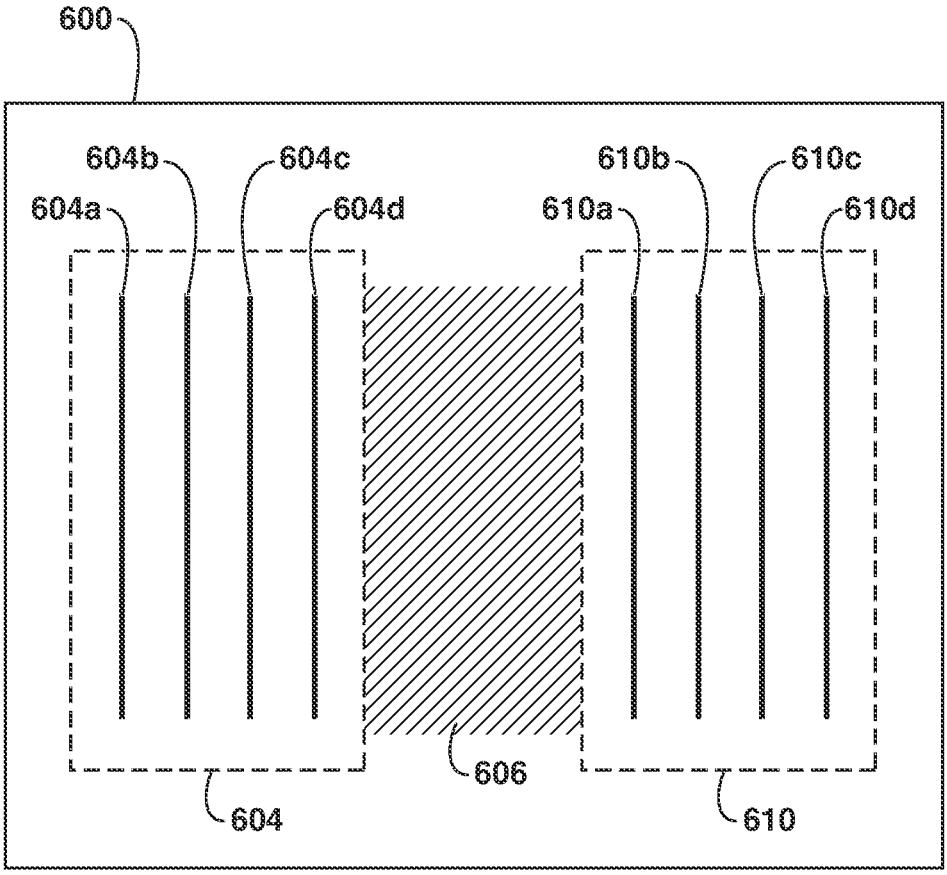
FIG. 6 is an example of the use of a buffer zone in accordance with a disclosed embodiment.

Furthermore, in a cyclic process, the two wells in a pair of wells do not have to be in proximity to one another and it is preferred that the wells in a pair are actually separated by a buffer zone. A "buffer zone" is a zone between wells that renders the wells substantially independent of one another; that is, the effect of one well will not have a substantial effect on the other well. In one embodiment of a full-field application, it is envisioned that the set of wells may be divided into two groups, each of which contains only one well in any given well pair. These two groups can be separated by a buffer (FIG. 6) and each well in a group will be in proximity to one another and operate in-sync (each has a similar well profile or a "similar injection cycle schedule", as defined below) with one another, and offset from the other group of corresponding wells in the corresponding well pairs as described below. In FIG. 6, the set (600) of eight wells comprises a group (604) of four injecting wells (604*a*, 604*b*, 604*c*, 604*d*) separated by a buffer zone (606) from a group (610) of four producing wells (610*a*, 610*b*, 610*c*, 610*d*). If the groups were operated such that each well of group (604) was paired with a well of group (610), then well (604*a*) might be paired with well (610*a*), and similarly for the other wells.

Solvent Management via Subsurface Storage

Another option for minimizing the variation in the net injected solvent, and thus the need for surface solvent storage, involves using a subsurface reservoir with at least a fraction of the initial in situ fluids extracted, to store solvent. Once at least a portion of the in situ fluids from a reservoir have been produced, the reservoir can be used as a solvent bank to store excess solvent and supply solvent as needed.

Solvent Supply

Solvent can be supplied via a supply pipeline or via trucking. Solvent supplied via a supply pipeline is often supplied at a constant daily supply rate, since a premium is often required to allow for variation in the solvent supply via pipeline. Solvent can also be progressively trucked in for start-up operation where less solvent may be needed than in full-field operation. This trucking could occur until plant capacity is reached in an economic fashion, which may be about ⅓ to ½ of the life of a single well. The maximum allowable daily solvent trucking rate may determine the plant and solvent recycling capacities. The number of new wells in start-up operation may be equal to the plant capacity divided by the predicted average calendar day oil rate per well in early cycles. In this scenario, solvent storage supply is desired to account for trucking interruptions, which can occur for several reasons including weather or supply disruptions. After steady operation has been established, solvent supply can be switched from trucking over to a pipeline.

Solvent Disposal

After oil production from the target wells have been reached, the excess produced solvent can be sent to another solvent injection site or transported to a vendor facility for resale. This solvent can be shipped via either pipeline, trucking, or a combination of trucking and pipeline.

Solvent Recovery

Once it has been determined that a well is no longer economic and will not undergo any more injection, the remaining recoverable solvent can be produced by depressurizing a portion of the reservoir below the vaporization pressure of the solvent at reservoir temperature to recover as much of the injected solvent as is economically feasible. Preferably, the pressure in the reservoir in contact with the injected solvent will drop to the pressure of the minimum allowable pressure to recover the maximum amount of solvent possible.

Field Operation

This entire process may be repeated throughout the field until an economic limit has been reached. When repeating this process it is economically advantageous to continue to use the existing pipeline and surface facilities.

Optimizing Oil Production Within a Solvent Supply or Storage Constraint

The procedures of computerized solvent storage optimization, well pairing, and well grouping just described, although useful for designing and managing a solvent supply system such that net solvent injection is minimized, are just one aspect of an efficient recovery process. Given a fixed volume of solvent supply and solvent storage, it is desirable to maximize oil production. Considering FIG. 3, the problem of maximizing oil production given a solvent storage constraint is the path where the constraint (312) is solvent storage and the optimized variable (310) is oil production. One way to mathematically represent the solvent's efficiency at obtaining oil production is the produced oil to injected solvent ratio (OISR), $$\text{Produced Oil to Injected Solvent Ratio} = Q_{PRODUCE}^{OIL}/Q_{INJECT}^{SOLVENT}. \quad (16)$$

An OISR may be defined for each producing well over any period of time for which there is both injection and production. Let's consider how to maximize the field-wide OISR under several different circumstances.

As long as $Q_{NET}>0$, as might occur during the late portion of the startup phase (224) and during most of the steady phase (226), there are new wells being drilled at the same time that other wells are producing. Because the solvent injection requirements are so large it makes sense to produce all wells at their full capacities when they are on production. Even if a well is not particularly efficient at producing oil, there is need for the produced solvent immediately, and no reason not to produce the oil.

The capacity of the recycle flowline (121) carrying the combined pipelined and produced solvent supply is necessarily of limited capacity. If it were to reach maximum capacity and the external solvent supply were already zero, it would be desirable to choke back, or decrease, the flow rate of recycled solvent from the wells with the lowest OISR. This situation might occur during the steady phase (226) of field life. The wells have differential solvent production rates and it is desirable to know which wells should be choked back. To accomplish this desired flow reduction the following may be carried out: (1) Calculate a solvent efficiency measure (such as OISR) using the solvent and oil flow rates for every well that feeds the solvent recycle line; (2) Rank all the wells from most to least solvent efficient; and (3) Reduce the solvent flow rate (including possible reduction to zero) of the least efficient well by reducing its gross production rate. Gross production rate may be decreased by increasing the producing pressure of the well. While reducing the solvent flow rate of the least efficient well is one approach, there may be instances where one would chose to produce at least one well of relatively lower efficiency at a lower rate than at least one well of relatively higher efficiency. For example, if ten wells are ranked from 1 (least efficient) to 10 (most efficient), reducing the flow rate of well 2 instead of well 1 could also be beneficial under the circumstances set out above.

The concept of choking back the solvent production rate by increasing the producing pressure is especially important in SDRPs. If the producing pressure is above the vaporization pressure, the solvent will be produced primarily as a liquid, and if the producing pressure is lower than the vaporizing pressure, the solvent will be produced primarily as a vapor. There is no analogy of this concept to steam-based processes, where substantially all of the steam is condensed to liquid phase water prior to production. Producing SDRP wells may therefore be operated either above or below the vaporization pressure, resulting in relatively low volumes of produced liquid phase solvent or relatively high volumes of produced vapor phase solvent. If surface solvent storage is not available, it may be advantageous to operate the wells above the vaporization pressure of the solvent such that solvent remains in the liquid phase and underground, rather than being produced. The process of vaporizing the solvent in the reservoir, and producing as much remaining solvent in the vapor phase as possible is known as "blowdown". The specific timing of blowdown, whether it occurs after every injection and production cycle or whether it occurs only during the final cycle of a CSDRP, may be an effective lever for controlling produced solvent volumes.

There may be a time during the life of the field when the surface storage capacity has been filled and there is more solvent available then is needed. This might occur, for example, shortly after $Q_{NET}$ falls below zero. At this point in time the surface storage will quickly fill up, but there may not be an efficient way to pipeline excess solvent away yet, perhaps because the pipeline operator will not accept low flow rates. Therefore, the only place to store the solvent is underground. It is expected that in practical field operations the magnitude of available underground storage will exceed the available surface storage capacity. If there are solvent injection wells available whose solvent injection rates may be increased without harming their overall performance, it may make sense to increase their injection rates. Nonetheless, some producing wells may need to be converted to underground solvent storage wells. It is desirable to maximize oil production even while converting some oil production wells to solvent storage wells. In this case, it may be desirable to convert the wells with the lowest oil rate (regardless of the specific OISR) to solvent storage wells. Another strategy for storing solvent underground is to operate a greater fraction of the producing wells above their vaporization pressure, storing solvent in the liquid state in the reservoir.

During the late life phase when there are no new wells being drilled and production is winding down, $Q_{NET}<0$ the optimization of oil production is straightforward—all wells should be produced as long as pipeline capacity to remove their produced solvent exists.

It is typically an object of oilfield practice to maximize profit, cash flow, net present value, or other measures of profitability. Given existing solvent storage constraints, maximizing oil production is typically synonymous with maximizing profitability. Should maximization of oil production not be synonymous with the maximization of profitability, it may be desirable to operate the SDRP oilfield such that the objective is direct maximization of a measure of profitability. For example, for low-pressure wells, it may be that the costs of the recompression of produced vapor phase solvent are so great in comparison to the volumes of coproduced oil, that the maximization of profitability would not be synonymous with maximization of oil production. The maximization of profitability might best be served by reducing the pressure of the producing well to as low a pressure as possible in order to recover the solvent in the vapor phase as quickly as possible, and forego oil production in the process. That is, there is a trade-off between a long period of low-rate oil production with some associated solvent in a relatively high-pressure pressure operation versus a short period of low-rate oil production and a relatively higher rate of solvent production at low-pressure. To the extent that operational costs (such as compression) are known and well production and injection profiles are known, direct optimization of a measure of profitability may be accomplished via the procedure of FIG. 3 where the optimized Variable (310) is a measure of profitability.

Additional Embodiments

The following embodiments serve to illustrate how aspects of the invention may be practiced in the context of the life of an oilfield operation.

One particular embodiment comprises operation for a solvent-dominated cyclic recovery process where solvent is trucked in, stored in inventory, injected into the reservoir, produced from the reservoir, separated from the produced reservoir fluids, and recycled with a phased-in solvent supply from pipelining where the following steps are followed:

1. Determine the maximum daily allowable solvent supply rate based on supplier constraints;

2. Use a system for developing an operational schedule to evaluate the optimal economic plant and solvent recycling capacity;

3. Design solvent surface storage based on making up for the most likely case of solvent trucking interruption;

4. Phase in a sufficient number of new wells so that plant capacity can be reached in a time equal to about ⅓ to ½ of the lifetime of the first well to undergo solvent injection;

5. Set the ratio of producing to injecting wells to be the same ratio as the average injection to produced solvent rate;

6. Establish a steady operation in which solvent trucking rate makes up solvent loss to reservoir;

7. Build solvent pipeline to replace trucking at 'X' time (likely years) before steady operation is achieved where X is the required regulatory approval, engineering, and construction time;

8. Phase out solvent trucking, phase-in pipeline supply;

9. Phase out solvent injection;

10. Phase out operation at the present location;

11. Blow down solvent inventory and send to new phase or for resale; and

12. Repeat at another field/phase using pipeline to supply solvent.

"Blow down" means that the pressure in a portion of the reservoir is dropped to below that of the vapor pressure of the solvent at the reservoir temperature, and production of the reservoir fluids along with the solvent is continued until either an economic limit is reached or another cutoff criteria is reached.

Alternatively, another embodiment comprises operation for a solvent-dominated cyclic recovery process where solvent is supplied via a pipeline at a near constant rate, optionally stored in inventory, injected into the reservoir, produced from the reservoir, separated from the produced reservoir fluids, and recycled where the following steps are followed:

1. Construct a pad with an even number of wells, such that each well can be paired with another well;

2. Use a system for developing an operational schedule to:

a. Predict the optimal injection and production rates for each well in the pad as well as the potential range of sustainable injection and production rates;

b. Evaluate the optimal plant and solvent recycling capacity;

c. Determine a supply rate for the pipeline based on supply constraints, recycling constraints, the average production rate expected for a given well, the number of wells in the pad, the average fraction by volume of the reservoir fluids at reservoir conditions that is comprised of the produced solvent, and the expected injection rate for a given well;

3. Design solvent surface storage based on making up for the most likely case of solvent supply interruption from either the pipeline or the underground reservoir storage;

4. Balance the solvent production rate from each well in a well pair and the appropriate fraction of solvent rate from the supply pipeline with the injection rate for the corresponding well in the given well pair to within the surface and/or underground reservoir storage capacity;

5. Phase in a sufficient number of new wells so that the incoming solvent pipeline supply can remain roughly constant (within ±10%) and the produced solvent from wells operating in the late-life cycles can be used efficiently;

6. Phase out solvent injection;

7. Phase out operation at the present location;

8. Blow-down solvent inventory and send to new phase or for resale;

9. Repeat at another field/phase using pipeline to supply solvent.

The system for developing an operational schedule may comprise:

1. A reservoir simulator that predicts one or more of: individual well injection rates, production rates, injected volumes, and produced volumes for one or more of the components of interest; and 2. A scheduler that takes individual well injection and production rates and groups wells together to optimize total solvent usage to within ±10% of the supply rate by one or more of the following means:

a. Operating wells in a group as a unit;

b. Offsetting well group start up dates;

c. Varying injection cycle length;

d. Varying idling or soak period between the injection and production cycles;

e. Varying production cycle length;

f. Varying idling or soak period between the production and injection cycles;

g. Using idling wells as solvent storage;

h. Recycling the produced solvent to be reinjected into a group of wells using separation and recompression facilities;

i. Installing an above ground storage capacity for solvent;

j. Using depleted reservoirs for solvent storage below the surface.

Table 1 outlines the operating ranges for CSDRPs of some embodiments. The present invention is not intended to be limited by such operating ranges.

TABLE 1

Operating Ranges for a CSDRP.

| Parameter | Broader Embodiment | Narrower Embodiment |
|---|---|---|
| Injectant volume | Fill-up estimated pattern pore volume plus 2-15% of estimated pattern pore volume; or inject, beyond a pressure threshold, for a period of time (for example weeks to months); or inject, beyond a pressure threshold, 2-15% of estimated pore volume. | Inject, beyond a pressure threshold, 2-15% (or 3-8%) of estimated pore volume. |
| Injectant composition, main | Main solvent (>50 mass %) $C_2$-$C_5$. Alternatively, wells may be subjected to compositions other than main solvents to improve well pattern performance (i.e. $CO_2$ flooding of a mature operation or altering in situ stress of reservoir). | Main solvent (>50 mass %) is propane ($C_3$). |
| Injectant composition, additive | Additional injectants may include $CO_2$ (up to about 30%), $C_{3+}$, viscosifiers (for example diesel, viscous oil, bitumen, diluent), ketones, alcohols, sulphur dioxide, hydrate inhibitors, and steam. | Only diluent, and only when needed to achieve adequate injection pressure. |
| Injectant phase & Injection pressure | Solvent injected such that at the end of injection, greater than 25% by mass of the solvent exists as a liquid in the reservoir, with no constraint as to whether most solvent is injected above or below dilation pressure or fracture pressure. | Solvent injected as a liquid, and most solvent injected just under fracture pressure and above dilation pressure, $P_{fracture} > P_{injection} > P_{dilation} > P_{vaporP}$. |
| Injectant temperature | Enough heat to prevent hydrates and locally enhance wellbore inflow consistent with Boberg-Lantz model. | Enough heat to prevent hydrates with a safety margin, Thydrate + 5° C. to Thydrate + 50° C. |
| Injection rate | 0.1 to 10 $m^3$/day per meter of completed well length (rate expressed as volumes of liquid solvent at reservoir conditions). | 0.2 to 2 $m^3$/day per meter of completed well length (rate expressed as volumes of liquid solvent at reservoir conditions). Rates may also be designed to allow for limited or controlled fracture extent, at fracture pressure or desired solvent conformance depending on reservoir properties. |
| Threshold pressure (pressure at which solvent continues to be injected for either a period of time or in a volume amount) | Any pressure above initial reservoir pressure. | A pressure between 90% and 100% of fracture pressure. |
| Well length | As long of a horizontal well as can practically be drilled; or the entire pay thickness for vertical wells. | 500 m-1500 m (commercial well). |
| Well configuration | Horizontal wells parallel to each other, separated by some regular spacing of 60-600 m; Also vertical wells, high angle slant wells & multi-lateral wells. Also infill injection and/or production wells (of any type above) targeting bypassed hydrocarbon from surveillance of pattern performance. | Horizontal wells parallel to each other, separated by some regular spacing of 60-320 m. |
| Well orientation | Orientated in any direction. | Horizontal wells orientated perpendicular to (or with less than 30 degrees of variation) the direction of maximum horizontal in situ stress. |

TABLE 1-continued

Operating Ranges for a CSDRP.

| Parameter | Broader Embodiment | Narrower Embodiment |
|---|---|---|
| Minimum producing pressure (MPP) | Generally, the range of the MPP should be, on the low end, a pressure significantly below the vapor pressure, ensuring vaporization; and, on the high-end, a high pressure near the native reservoir pressure. For example, perhaps 0.1 MPa-5 MPa, depending on depth and mode of operation (all-liquid or limited vaporization). | A low pressure below the vapor pressure of the main solvent, ensuring vaporization, or, in the limited vaporization scheme, a high pressure above the vapor pressure. At 500 m depth with pure propane, 0.5 MPa (low)-1.5 MPa (high), values that bound the 800 kPa vapor pressure of propane. |
| Oil rate | Switch to injection when rate equals 2 to 50% of the max rate obtained during the cycle; Alternatively, switch when absolute rate equals a pre-set value. Alternatively, well is unable to sustain hydrocarbon flow (continuous or intermittent) by primary production against backpressure of gathering system or well is "pumped off" unable to sustain flow from artificial lift. Alternatively, well is out-of-synch with adjacent well cycles. | Switch when the instantaneous oil rate declines below the calendar day oil rate (CDOR) (for example total oil/total cycle length). Likely most economically optimal when the oil rate is at about 0.8 × CDOR. Alternatively, switch to injection when rate equals 20-40% of the max rate obtained during the cycle. |
| Gas rate | Switch to injection when gas rate exceeds the capacity of the pumping or gas venting system. Well is unable to sustain hydrocarbon flow (continuous or intermittent) by primary production against backpressure of gathering system with/or without compression facilities. | Switch to injection when gas rate exceeds the capacity of the pumping or gas venting system. During production, an optimal strategy is one that limits gas production and maximizes liquid from a horizontal well. |
| Oil to Solvent Ratio | Begin another cycle if the OISR of the just completed cycle is above 0.15 or economic threshold. | Begin another cycle if the OISR of the just completed cycle is above 0.3. |
| Abandonment pressure (pressure at which well is produced after CSDRP cycles are completed) | Atmospheric or a value at which all of the solvent is vaporized. | For propane and a depth of 500 m, about 340 kPa, the likely lowest obtainable bottomhole pressure at the operating depth and well below the value at which all of the propane is vaporized. |

In Table 1, embodiments may be formed by combining two or more parameters and, for brevity and clarity, each of these combinations will not be individually listed.

In the context of this specification, diluent means a liquid compound that can be used to dilute the solvent and can be used to manipulate the viscosity of any resulting solvent-bitumen mixture. By such manipulation of the viscosity of the solvent-bitumen (and diluent) mixture, the invasion, mobility, and distribution of solvent in the reservoir can be controlled so as to increase viscous oil production.

The diluent is typically a viscous hydrocarbon liquid, especially a $C_4$ to $C_{20}$ hydrocarbon, or mixture thereof, is commonly locally produced and is typically used to thin bitumen to pipeline specifications. Pentane, hexane, and heptane are commonly components of such diluents. Bitumen itself can be used to modify the viscosity of the injected fluid, often in conjunction with ethane solvent.

In certain embodiments, the diluent may have an average initial boiling point close to the boiling point of pentane (36° C.) or hexane (69° C.) though the average boiling point (defined further below) may change with reuse as the mix changes (some of the solvent originating among the recovered viscous oil fractions). Preferably, more than 50% by weight of the diluent has an average boiling point lower than the boiling point of decane (174° C.). More preferably, more than 75% by weight, especially more than 80% by weight, and particularly more than 90% by weight of the diluent, has an average boiling point between the boiling point of pentane and the boiling point of decane. In further preferred embodiments, the diluent has an average boiling point close to the boiling point of hexane (69° C.) or heptane (98° C.), or even water (100° C.).

In additional embodiments, more than 50% by weight of the diluent (particularly more than 75% or 80% by weight and especially more than 90% by weight) has a boiling point between the boiling points of pentane and decane. In other embodiments, more than 50% by weight of the diluent has a boiling point between the boiling points of hexane (69° C.) and nonane (151° C.), particularly between the boiling points of heptane (98° C.) and octane (126° C.).

By average boiling point of the diluent, we mean the boiling point of the diluent remaining after half (by weight) of a starting amount of diluent has been boiled off as defined by ASTM D 2887 (1997), for example. The average boiling point can be determined by gas chromatographic methods or more tediously by distillation. Boiling points are defined as the boiling points at atmospheric pressure.

In the preceding description, for purposes of explanation, numerous details are set forth in order to provide a thorough understanding of the embodiments of the invention. However, it will be apparent to one skilled in the art that these specific details are not required in order to practice the invention.

Embodiments of the invention can be represented as a software product stored in a machine-readable medium (also referred to as a computer-readable medium, a processor-readable medium, or a computer usable medium having a computer-readable program code embodied therein). The machine-readable medium can be any suitable tangible medium, including magnetic, optical, or electrical storage medium including a diskette, compact disk read only memory (CD-ROM), memory device (volatile or non-volatile), or similar storage mechanism. The machine-readable medium can contain various sets of instructions, code sequences, configuration information, or other data, which, when executed, cause a processor to perform steps in a method according to an embodiment of the invention. Those of ordinary skill in the art will appreciate that other instructions and operations necessary to implement the described invention can also be stored on the machine-readable medium. Software running from the machine-readable medium can interface with circuitry to perform the described tasks.

The above-described embodiments of the invention are intended to be examples only. Alterations, modifications and variations can be effected to the particular embodiments by those of skill in the art without departing from the scope of the invention, which is defined solely by the claims appended hereto.

The invention claimed is:

1. A method of reducing surface solvent storage need for a solvent-dominated process for recovering hydrocarbons from an underground reservoir, the method comprising:

(a) injecting a viscosity-reducing solvent into the underground reservoir;

(b) allowing the viscosity-reducing solvent to reduce a viscosity of the hydrocarbons, wherein at least 50% of the reduction in the viscosity of the hydrocarbons is due to chemical solvation; and (c) producing the reduced viscosity hydrocarbons from the underground reservoir; and (d) minimizing a volume of the viscosity-reducing solvent in a surface solvent storage tank by selecting a schedule that minimizes variation in a net solvent injection rate before jointly injecting and producing, wherein the schedule comprises injecting the viscosity-reducing solvent into a first group of wells, while producing the hydrocarbons from a second group of wells, wherein a net solvent injection rate is a difference between a total solvent injection rate and a total solvent production rate for a set of wells, and wherein the surface solvent storage tank comprises a tank having a volume of at least 500 cubic meters.

2. The method of claim 1 wherein the net solvent injection rate is based on a time period of at least twelve hours.

3. The method of claim 1 wherein the schedule reduces the variation in the net solvent injection rate to an amount where an average daily difference between an injected solvent volume and a produced solvent volume from the set of wells is within 20% of an average difference over a time period of one month.

4. The method of claim 1 wherein the schedule reduces the variation in the net solvent injection rate to an amount where an average hourly difference between an injected solvent volume and a produced solvent volume from a set of wells is within 50% of an average difference over a time period of one day.

5. The method of claim 1 wherein the schedule minimizes the variation in the net solvent injection rate to below 10% over a daily period.

6. The method of claim 5 wherein the solvent-dominated process is a cyclic solvent-dominated recovery process.

7. The method of claim 6 wherein the schedule further comprises injecting the viscosity-reducing solvent into a first well of a pair of two wells, while producing the hydrocarbons from a second well of the pair of two wells.

8. The method of claim 6 wherein the schedule further comprises injecting the viscosity-reducing solvent into a first well of a pair of two wells at a daily rate of +/−10% of a daily rate of the viscosity-reducing solvent simultaneously produced from a second well of the pair of two wells plus an amount of the viscosity-reducing solvent supply from a solvent source constant to +/−10% on a daily basis.

9. The method of claim 8 wherein wells of the pair of two wells are separated from one another by a buffer zone for limiting well-to-well interaction.

10. The method of claim 8 operated in a plurality of the pair of two wells.

11. The method of claim 5 wherein the solvent-dominated process is a non-cyclic solvent-dominated recovery process.

12. The method of claim 11 wherein the schedule further comprises injecting the viscosity-reducing solvent into the first group of wells at a rate of +/−10% of a daily rate of the viscosity-reducing solvent being simultaneously produced from the second group of wells plus an amount of the viscosity-reducing solvent supply from a solvent source constant to +/−10% on a daily basis.

13. The method of claim 11 wherein the schedule further comprises operating the set of wells in groups with offset injection schedules, by:

alternating between injecting and not significantly injecting into at least two groups of injection wells, wherein wells within a first group have similar injection schedules; wells within a second group have similar injection schedules; wells of the first group have injection schedules that are offset in time from the wells of the second group; and alternating between producing and not significantly producing in production wells that are distinct from the injection wells.

14. The method of claim 1 wherein the first and second group of wells are separated from one another by a buffer zone for limiting well-to-well interaction.

15. The method of claim 1 operated in a plurality of well groups.

16. The method of claim 1 wherein the solvent-dominated process comprises injecting a fluid into the formation, the fluid comprising greater than 50 mass % of the viscosity-reducing solvent.

17. The method of claim 16 wherein immediately after halting injection of the viscosity-reducing solvent into the underground reservoir, at least 25 mass % of the viscosity-reducing solvent injected into the underground reservoir is in a liquid state in the underground reservoir.

18. The method of claim 16 wherein the viscosity-reducing solvent comprises greater than 50 mass % of a $C_2$-$C_5$ paraffinic hydrocarbon solvent.

19. The method of claim 1 wherein, in the solvent-dominated process, at least 25 mass % of the viscosity-reducing solvent enters the underground reservoir as a liquid.

20. The method of claim 1 wherein the hydrocarbons are a viscous oil having an in situ viscosity of at least 10 cP at initial reservoir conditions.

21. The method of claim 1, wherein minimizing variation comprises minimizing a ratio of a maximum net injected solvent volume over a time period divided by an average of a net injected solvent volume over the time period.

* * * * *